US007812554B2

(12) United States Patent
Takahashi

(10) Patent No.: US 7,812,554 B2
(45) Date of Patent: Oct. 12, 2010

(54) CONTROL DEVICE FOR OPENING/CLOSING MEMBER

(75) Inventor: Tomohiro Takahashi, Toyota (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 461 days.

(21) Appl. No.: 11/868,207

(22) Filed: Oct. 5, 2007

(65) Prior Publication Data

US 2008/0110092 A1 May 15, 2008

(30) Foreign Application Priority Data

Oct. 6, 2006 (JP) ..... 2006-275653

(51) Int. Cl.
*E05F 15/10* (2006.01)

(52) U.S. Cl. ..... 318/282; 318/266; 318/456; 318/468; 318/469

(58) Field of Classification Search ..... 318/255–257, 318/264–266, 268, 272, 280, 282, 286, 466–470, 318/434, 456

See application file for complete search history.

(56) References Cited

U.S. PATENT DOCUMENTS

| | | | | |
|---|---|---|---|---|
| 5,278,480 | A * | 1/1994 | Murray | 318/626 |
| 5,832,664 | A | 11/1998 | Tajima et al. | |
| 6,274,947 | B1 * | 8/2001 | Terashima | 307/10.1 |
| 6,504,332 | B1 * | 1/2003 | Lamm | 318/445 |
| 6,580,242 | B2 * | 6/2003 | Hirose et al. | 318/445 |
| 7,019,476 | B2 * | 3/2006 | Konigshaus | 318/280 |
| 7,579,708 | B2 * | 8/2009 | Shibata et al. | 307/10.1 |
| 2006/0290309 | A1 * | 12/2006 | Saitou et al. | 318/469 |

FOREIGN PATENT DOCUMENTS

| | | | |
|---|---|---|---|
| EP | 0 716 492 | A1 * | 6/1996 |
| JP | 2555475 | Y2 | 8/1997 |
| JP | 2857048 | B2 | 11/1998 |
| JP | 2002-327574 | A | 11/2002 |
| JP | 2005-231539 | | 9/2005 |
| WO | WO 2006/102162 | A1 * | 9/2006 |

OTHER PUBLICATIONS

Patent Abstracts of Japan, Publication No. 2002-327574, Publication Date: Nov. 15, 2002, 1 page.
Patent Abstracts of Japan for patent applictaion with Publication No. 2005-231539, Publication Date: Sep. 2, 2005, 1 page.

* cited by examiner

*Primary Examiner*—Bentsu Ro
(74) *Attorney, Agent, or Firm*—Osha Liang LLP

(57) ABSTRACT

A control device for an opening/closing member includes a speed detecting unit, a variation calculating unit, a judgment unit, a control unit, and a state detecting unit. The speed detecting unit detects a rotation speed of a motor for opening/closing the opening/closing member. The variation calculating unit calculates the variation in the rotation speed based on a present value and a past value of the rotation speed. The judgment unit compares the variation to a predetermined threshold value and judges whether or not a foreign object is trapped in the opening/closing member based on the comparison. The control unit controls the motor to open or stop the opening/closing member when the judgment unit judges that there is a foreign object trapped. The state detecting unit detects a state of the opening/closing member or a state of the surroundings of the opening/closing member.

9 Claims, 21 Drawing Sheets

Fig. 1. PRIOR ART
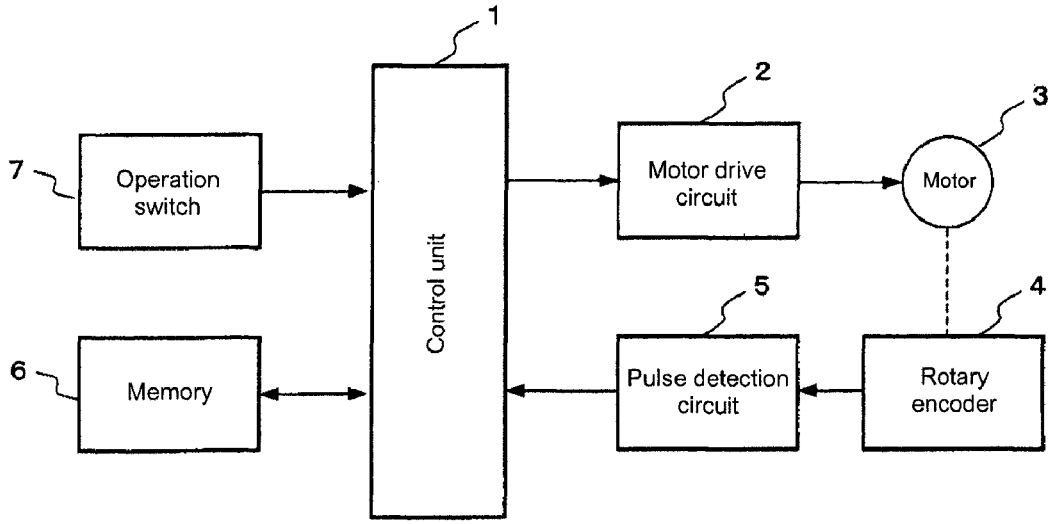
Fig. 2. PRIOR ART
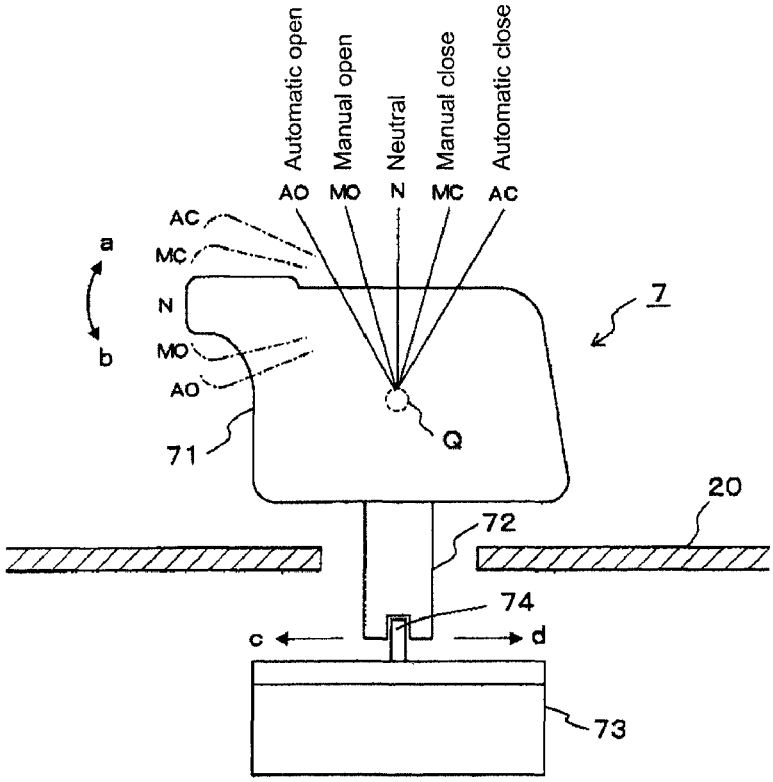

Fig. 3. PRIOR ART
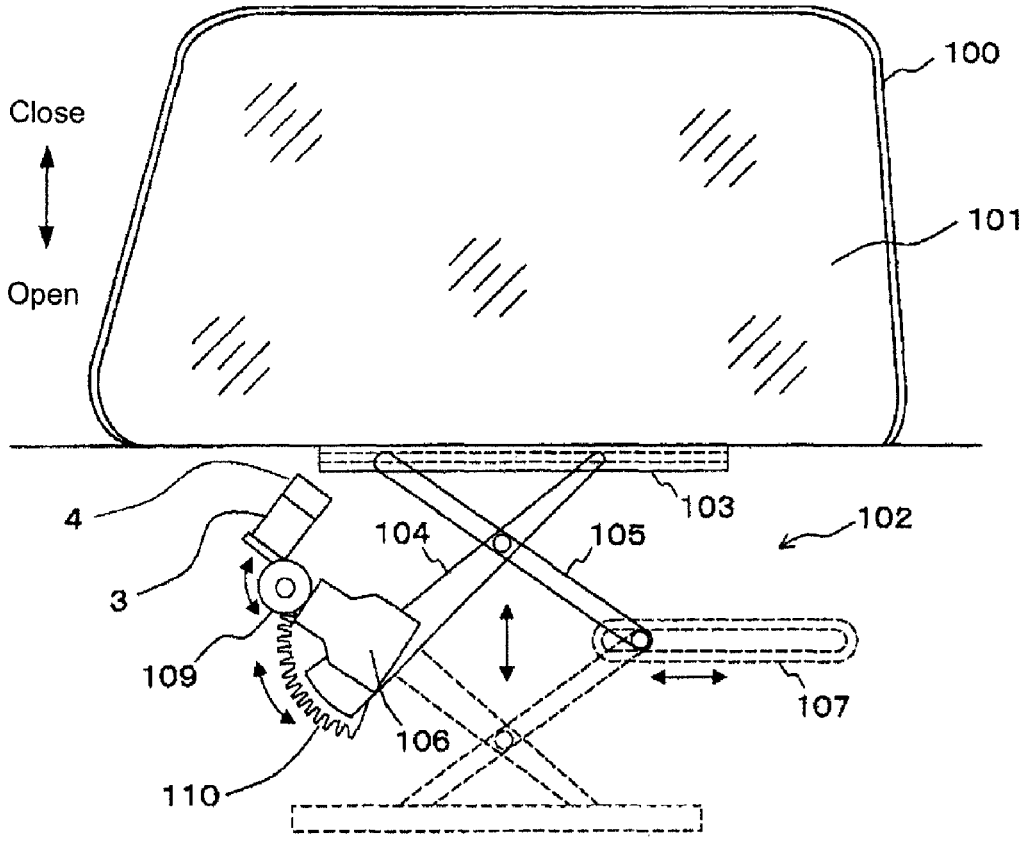

Fig. 4. PRIOR ART
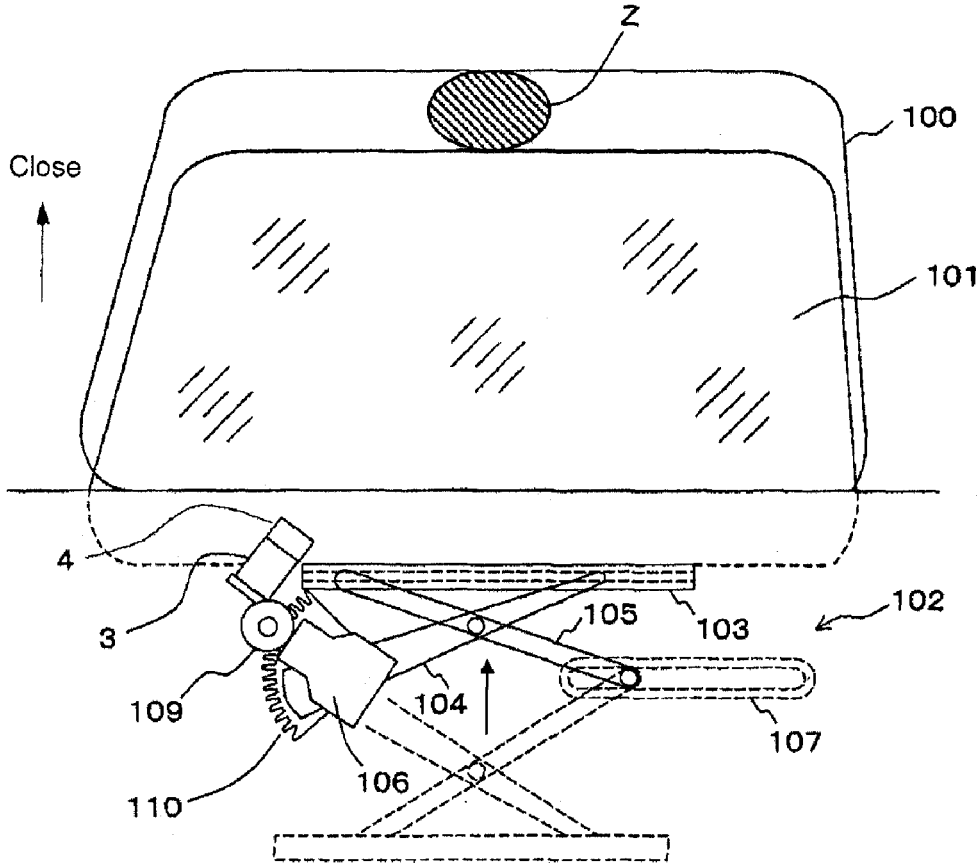

Fig. 6

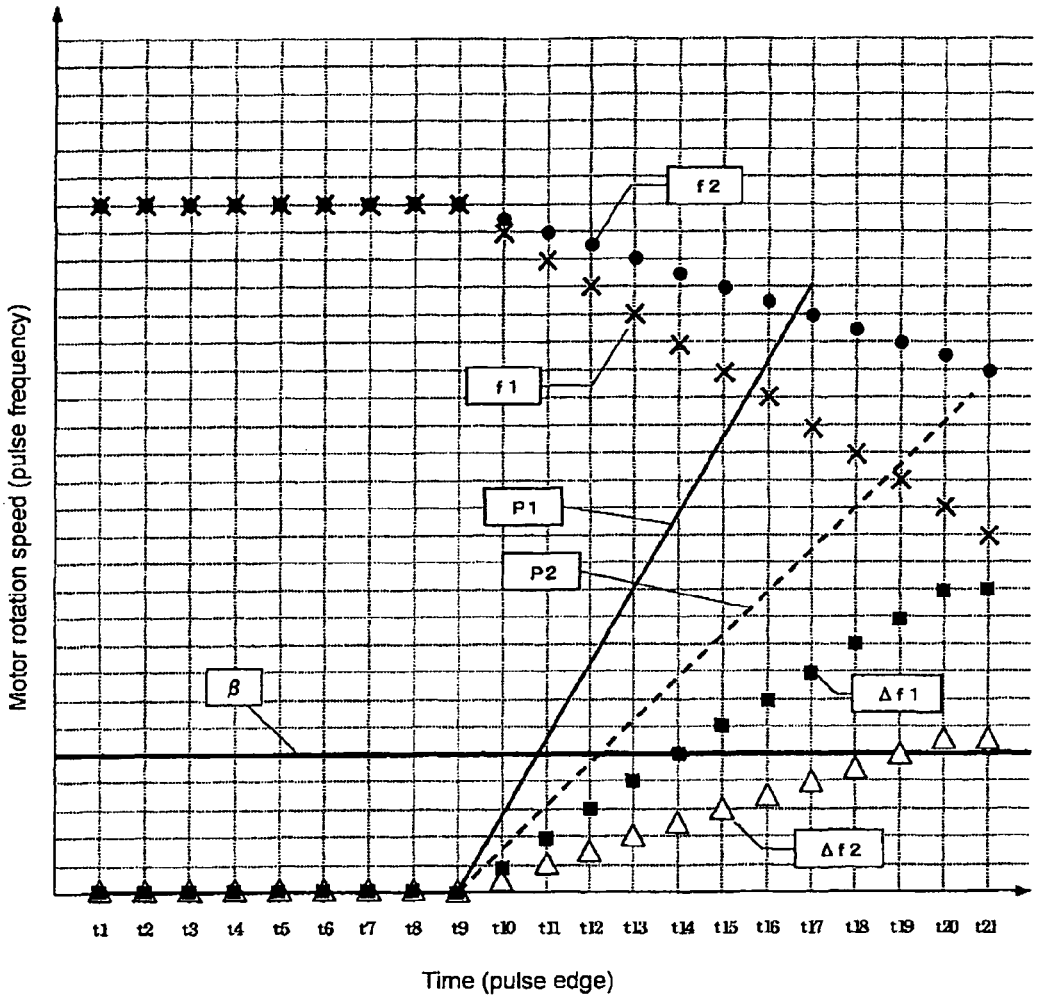

f1 : Pulse frequency generated when entrapment occurred near window fully opened position
f2 : Pulse frequency generated when entrapment occurred near window fully closed position
Δf1 : Variation in pulse frequency f1
Δf2 : Variation in pulse frequency f2
p1 : Entrapment load generated when entrapment occurred near window fully opened position
p2 : Entrapment load generated when entrapment occurred near window fully closed position
β : Threshold value

Fig. 13

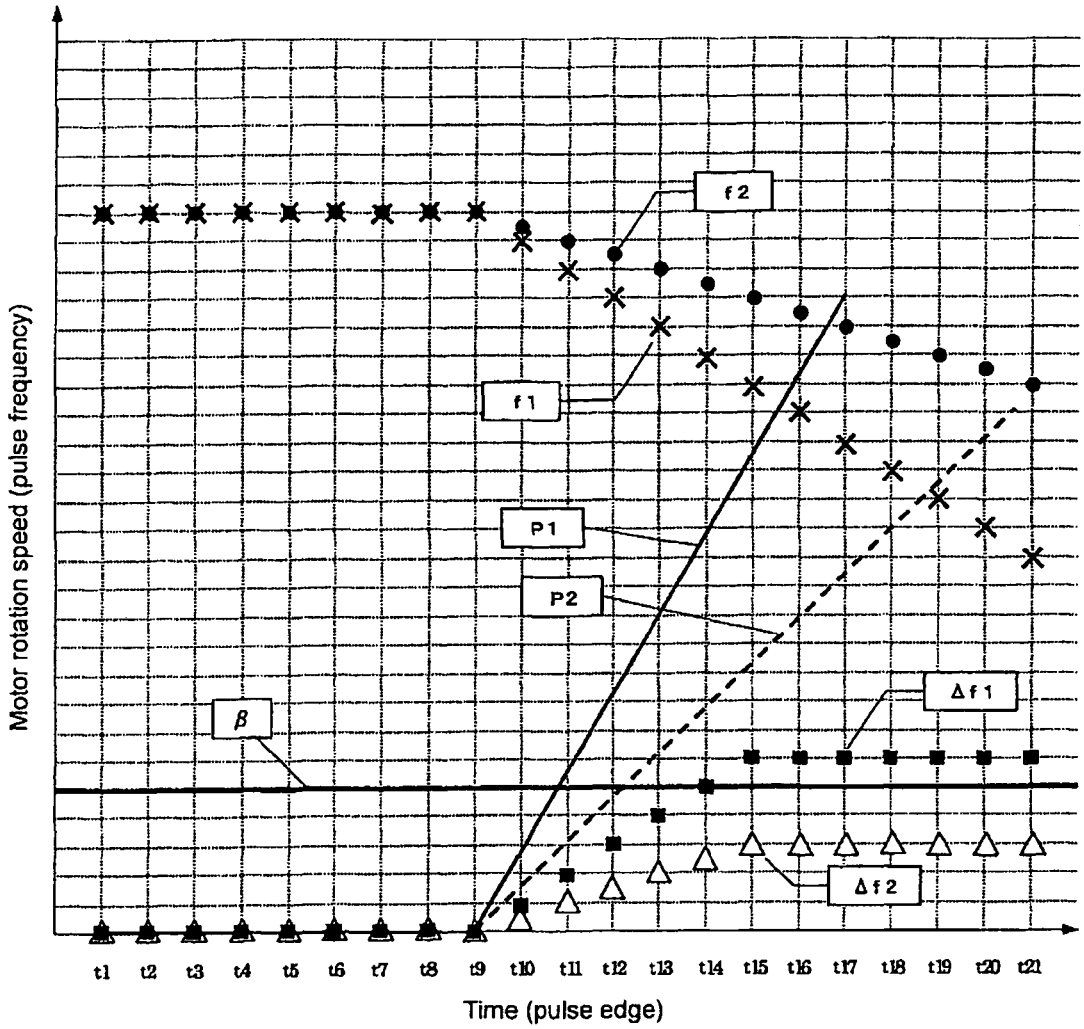

f1 : Pulse frequency generated when entrapment occurred near window fully opened position
f2 : Pulse frequency generated when entrapment occurred near window fully closed position
Δf1 : Variation in pulse frequency f1
Δf2 : Variation in pulse frequency f2
p1 : Entrapment load generated when entrapment occurred near window fully opened position
p2 : Entrapment load generated when entrapment occurred near window fully closed position
β : Threshold value

CONTROL DEVICE FOR OPENING/CLOSING MEMBER

BACKGROUND OF THE INVENTION

1. Field of the Invention

The present invention relates to a control device for an opening/closing member such as a control device for opening/closing a window (hereinafter referred to as "power window device") used in a vehicle.

2. Description of the Related Art

A power window device is a device for forward rotating and reverse rotating a motor by operating a switch, and raising and lowering a window glass of a door to open/close a window. FIG. 1 shows a block diagram of an electrical configuration of the power window device. A control unit 1 including a CPU controls the opening/closing operation of the window, a motor drive circuit 2 drives a motor 3, a rotary encoder 4 outputs a pulse synchronized with a rotation of the motor 3, a pulse detection circuit 5 detects a pulse output from the rotary encoder 4, a memory 6 is configured by a ROM, a RAM, or the like, and an operation switch 7 operates the opening/closing of the window.

When the operation switch 7 is operated, a window opening/closing command is provided to the control unit 1, and the motor 3 is forward rotated and reverse rotated by the motor drive circuit 2. A window opening/closing mechanism linked with the motor 3 operates through rotation of the motor 3, and opening/closing of the window is performed. The pulse detection circuit 5 detects the pulse output from the rotary encoder 4, and the control unit 1 calculates a rotation speed of the motor and the moved distance of the window based on the detection result, and controls the rotation of the motor 3 via the motor drive circuit 2.

FIG. 2 shows a schematic configuration view of one example of the operation switch 7. The operation switch 7 is configured by an operation knob 71 rotatable in an a-b direction with an axis Q as the center, a rod 72 arranged integrally with the operation knob 71, and a known slide switch 73. The slide switch 73 has an actuator 74, and the operation switch 7 is incorporated in a switch unit 20. A lower end of the rod 72 engages the actuator 74 of the slide switch 73, where the actuator 74 moves in a c-d direction by way of the rod 72 when the operation knob 71 is rotated in the a-b direction, so that a contacting point (not shown) of the slide switch 73 switches according to the moved position.

The operation knob 71 can be switched to each position of automatic close AC, manual close MC, neutral N, manual open MO, and automatic open AO. FIG. 2 shows a state in which the operation knob 71 is at the neutral N position. When the operation knob 71 is rotated by a constant amount in an a direction from such position and positioned at the manual close MC position, a manual closing operation in which the window is closed through manual operation is performed, and when the operation knob 71 is further rotated in the a direction and positioned at the automatic close AC position, the automatic closing operation in which the window is closed through automatic operation is performed. When the operation knob 71 is rotated by a constant amount in a b direction and positioned at the manual open MO position, the manual opening operation in which the window is opened through manual operation is performed, and when the operation knob 71 is further rotated in the b direction and positioned at the automatic open AO position, the automatic opening operation in which the window is opened through automatic operation is performed. A spring (not shown) is arranged in the operation knob 71, so that the operation knob 71 returns to the neutral N position by a force of the spring when the hand is taken off from the rotated operation knob 71.

In the case of manual operation, an operation of closing the window or an operation of opening the window is carried out while the operation knob 71 is being held by hand at the position of manual close MC or manual open MO, and the closing operation or the opening operation of the window stops when the hand is taken off from the operation knob 71 and the knob is returned to the neutral N position. In the case of automatic operation, once the operation knob 71 is rotated to the position of automatic close AC or automatic open AO, the closing operation or the opening operation of the window is thereafter continuously carried out even when the hand is taken off from the operation knob 71 and the operation knob is returned to the neutral N position.

FIG. 3 shows a view of one example of the window opening/closing mechanism arranged on each window of the vehicle. Reference symbol 100 is a window of the vehicle, 101 is a window glass for opening and closing the window 100, and 102 is the window opening/closing mechanism. The window glass 101 rises and lowers by an operation of the window opening/closing mechanism 102, where the window 100 closes by raising the window glass 101 and the window 100 opens by lowering the window glass 101. In the window opening/closing mechanism 102, a supporting member 103 is attached to a lower end of the window glass 101. A first arm 104 has a first end engaging the supporting member 103 and a second end being rotatably supported by the blanket 106, and a second arm 105 having a first end engaging the supporting member 103 and a second end engaging a guide member 107 are provided. The first arm 104 and the second arm 105 are connected at the respective intermediate part by way of a shaft. Reference symbol 3 is the motor described above, and reference symbol 4 is the rotary encoder described above. The rotary encoder 4 is connected to a rotation shaft of the motor 3, and outputs a pulse of the number proportional to a rotation amount of the motor 3. A rotation speed of the motor 3 can be detected by counting a pulse output from the rotary encoder 4 within a predetermined time. Furthermore, the rotation amount of the motor 3 (moved distance of the window glass) can be calculated from an output of the rotary encoder 4.

A pinion 109 is rotatably driven by the motor 3, and a fan shaped gear 110 rotates by gearing with the pinion 109. The gear 110 is fixed to the first arm 104. The motor 3 is rotatable in a forward and reverse direction, where the pinion 109 and the gear 110 are rotated by such rotation in the forward and reverse direction thereby turning the first arm 104 in the forward and reverse direction. Following thereto, the other end of the second arm 105 slides in the lateral direction along a groove of a guide member 107 and the supporting member 103 moves in an up and down direction to raise and lower the window glass 101, thereby opening or closing the window 100.

A function for detecting entrapment of an object when the operation knob 71 is at the automatic close AC position in FIG. 2 and automatic closing operation is performed is provided to the power window device configured as above. In other words, when an object Z gets entrapped in a gap of the window glass 101 while the window 100 is being closed, as shown in FIG. 4, such entrapment is detected, and the closing operation of the window 100 is switched to the opening operation. Since the window 100 automatically closes during the automatic closing operation, an entrapment detection mechanism acts from the necessity of preventing human body from being harmed thereby prohibiting the closing operation of the window 100 when hand, neck, or the like gets entrapped by an accident. In detecting entrapment, the rotation speed of the motor 3, which is an output of the pulse detection circuit 5, is read by the control unit 1, as needed, and a present rotation speed and a past rotation speed are compared to determine the presence of entrapment based on the comparison result (variation in rotation speed). When the object Z is entrapped in the window 100, a load of the motor 3 increases, the rotation speed decreases and the variation in speed increases, where judgment is made that the object Z is entrapped when the variation in speed exceeds a predetermined threshold value. The threshold value is stored in the memory 6 in advance.

In the window opening/closing mechanism 102 shown in FIGS. 3 and 4, the first arm 104 and the second arm 105 configure an X-shaped link mechanism, and a power of the motor 3 is transmitted to the window glass 101 through the link mechanism. The arms configuring the X-shaped link mechanism are hereinafter referred to as "X-arm". A detailed mechanism of the X-arm is described in Japanese Utility Model Registration Publication No. 2555475 to be hereinafter described. In addition to the X-arm, a single arm configured by only one arm may be used for the window opening/closing mechanism.

When a weather strip (not shown) arranged in a sash of the window 100 contacts the window glass 101 near a fully closed position of the window glass 101, a movement speed of the window glass 101 decreases due to friction generated by such contact. When the movement speed decreases, a variation in speed reduces and becomes lower than the threshold value even if entrapment occurred, and thus entrapping may not be accurately detected.

A power window device is thus disclosed in Japanese Patent Publication No. 2857048 in which a region in which the window moves from a fully opened state to a fully closed state is divided into plurals, a different threshold value is set for every region, and judgment is made that foreign object is entrapped when the load exceeds the corresponding threshold value, thereby correctly making the judgment of entrapment of the foreign object even if the movement speed decreases near the fully closed position of the window glass. A control device for an opening/closing member is disclosed in Japanese Laid-Open Patent Publication no. 2002-327574 in which the rotation speed of the motor is reduced in a predetermined interval near the fully closed position to increase the margin with respect to an entrapment load and prevent mistaken judgment of entrapment caused by friction of the weather strip or the like and in which the output of the motor is increased when the rotation speed becomes lower than or equal to a defined value immediately before the fully closed position to reliably close the opening/closing member.

SUMMARY OF THE INVENTION

In the window opening/closing mechanism using the X-arm or the single arm, the movement speed of the glass decreases as the window glass 101 approaches the fully closed position assuming the rotation speed of the motor 3 is constant. This will be described in a principle diagram of FIG. 12. In FIG. 12, A is an arm that turns in cooperation with a rotation of the motor M, W is a window glass that rises and lowers by a turning of the arm A, and R is a rail that guides a distal end of the arm A. For the sake of simplifying the description, the arm A is assumed as a single arm. The arm A corresponds to the first arm 104 of FIG. 3, and the rail R corresponds to the supporting member 103 of FIG. 3.

Assuming a moved distance of the window glass W when the arm A is turned upward by an angle θ from an initial position (position at where the window is fully opened) of a horizontal state is Y1, and the moved distance of the window glass W when the arm A is turned by angle θ from a position close to a final position (position at where the window is fully closed) to the final position is Y2, where Y1>Y2, a relationship between a speed V1 at which the window glass W moves the distance of Y1 and a speed V2 at which the window glass W moves a distance of Y2 with the rotation speed of the motor M constant is V1>V2. In other words, the movement speed of the window glass W is large near a fully opened position, and the movement speed decreases as the position approaches the fully closed position. Consequently, when entrapment occurs near the fully closed position, a variation in speed reduces and becomes lower than the threshold value, and thus the entrapment may not be accurately detected. This will be described in detail below.

FIG. 13 shows a graph of an example of temporal change in a motor rotation speed. The motor rotation speed on a vertical axis is assumed as a frequency of an output pulse of the rotary encoder 4. A time on the horizontal axis represents a timing of pulse edge of the output pulse. The symbol f1 shows a pulse frequency (motor rotation speed) generated when entrapment occurred when the window is near the fully opened position, and f2 shows the pulse frequency (motor rotation speed) generated when entrapment occurred when the window is near the fully closed position. A curve of f1 and a curve of f2 should be shifted in a time axis (horizontal axis) direction, but are drawn at the same position for the sake of convenience of comparison. Δf1 indicates variation in the pulse frequency f1, and Δf2 indicates variation in the pulse frequency f2. Furthermore, P1 shows the entrapment load generated when entrapment occurs near the fully opened position of the window, and P2 shows the entrapment load generated when entrapment occurs near the fully closed position of the window. β is a threshold value for detecting entrapment by being compared with the variations Δf1 and Δf2 of the pulse frequency.

In FIG. 13, entrapment occurred at a timing of t10, and thereafter, the rotation speed of the motor decreased. In order to detect entrapment, the variation in the motor rotation speed must be calculated, and such variation must be compared with the threshold value β. A difference in pulse frequency, that is, the variation is calculated based on a present value of the pulse frequency and a past value at the time point of a constant period before the present time. The variation Δf in pulse frequency (rotation speed) is calculated by the following equation.

$$\Delta f = f(m-a) - f(m) \tag{1}$$

where f(m) is a present value of the pulse frequency at an arbitrary timing $t_m$, a is a comparison interval of the frequency difference, and f(m−a) is the past value of the pulse frequency at the time point of a before $t_m$. For instance, if a=6 and m=19, the pulse frequency at timing t19 is the present value, the pulse frequency at t13, which is 6 timings before t19, is the past value, and the variation Δf in the pulse frequency at t19 is Δf=f(13)−f(19) from equation (1).

The variation Δf in pulse frequency for each timing obtained as above is compared with the threshold value β, where judgment is made that entrapment occurred if Δf≧β. Δf1 of FIG. 13 shows the variation in pulse frequency obtained from equation (1) when entrapment occurred when the window is near the fully opened position, and Δf2 shows the variation in the pulse frequency obtained from equation (1) when entrapment occurred when the window is near the fully closed position. Comparing a decreasing degree of the pulse frequency f1 and a decreasing degree of the pulse frequency f2, the movement speed of the window glass becomes small near the window fully closed position, as described above, and thus the decreasing degree of the pulse frequency f2 is smaller than that of the pulse frequency f1. Therefore, the variation Δf2 in the pulse frequency generated when entrapment occurred near the window fully closed position is smaller than the variation Δf1 in the pulse frequency generated when entrapment occurred near the window fully opened position. Therefore, if variation is obtained with a=6 in equation (1), the variation reaches the threshold value β at t14 and entrapment can be detected for Δf1, but the variation from t15 is saturated and does not reach the threshold value β and thus entrapment cannot be detected for Δf2. As a result, the window glass will not perform reversing operation in an opening direction even though entrapment has occurred, whereby the load applied on the entrapped object increases thereby leading to damage or the like.

In a conventional device, therefore, the entrapment cannot be detected if entrapment occurred near the fully closed position of the window. Furthermore, in the method of Japanese Patent Publication No. 2857048, a troublesome work of dividing a movement region of the window from fully opened to fully closed into plurals and setting different thresholds values for each region is involved. In the method of Japanese Laid-Open Patent Publication No. 2002-327574, the rotation speed of the motor is forcibly decreased near the window fully closed position, and thus entrapment may not be normally detected.

The rotation speed of the motor in time of entrapment is influenced by not only the position of the window but also by other factors. For instance, the decreasing degree of the rotation speed of the motor differs between a case where the hand of an adult is entrapped and a case where the hand of a child is entrapped since the hardness of the hand is different. Moreover, the rotation speed of the motor fluctuates by a surrounding temperature, a road surface condition, an aged change, or the like even if entrapment has not occurred. Thus, mistaken judgment of entrapment might be made by such factors.

The present invention aims to easily realize a control device for an opening/closing member that can accurately detect entrapment even if the movement speed of the opening/closing member fluctuates by various factors.

A control device for opening/closing member of the present invention includes a speed detecting unit for detecting a rotation speed of a motor for opening/closing the opening/closing member; a variation calculating unit for calculating variation in the rotation speed based on a present value and a past value of the rotation speed detected by the speed detecting unit; a judgment unit for comparing the variation calculated by the variation calculating unit and a predetermined threshold value and judging whether or not a foreign object is entrapped in the opening/closing member based on the comparison result; a control unit for controlling the motor to open or stop the opening/closing member when judged that the foreign object is entrapped by the judgment unit; and a state detecting unit for detecting a state of the opening/closing member or state of surrounding of the opening/closing member. The variation calculating unit selects an earlier past value or a past value close to the present as the past value of the rotation speed according to the state detected by the state detecting unit, and calculates the variation in the rotation speed using the past value and the present value.

In the present invention, the state detecting unit for detecting the state of the opening/closing member and the surrounding thereof is arranged, where the past value of the rotation speed is selected according to the detection result of the detecting unit, and thus the variation in the rotation speed can be made large or small by using the earlier past value or the past value closer to the present according to the state, whereby entrapment can be accurately detected even if the movement speed of the opening/closing member fluctuates due to various factors.

The state detecting unit may be a position detecting unit for detecting a position of the opening/closing member. In this case, the variation calculating unit selects an earlier past value as the past value of the rotation speed when the position detecting unit detects that the opening/closing body has moved a predetermined distance in a direction that a movement speed decreases, and calculates the variation in the rotation speed using the past value and the present value. Specifically, the variation calculating unit calculates the variation in the rotation speed based on the present value of the rotation speed and a past value at a time point of a first period T1 before the present value until the position detecting unit detects that the opening/closing member has moved the predetermined distance in the direction that the movement speed decreases, and calculates the variation in the rotation speed based on the present value of the rotation speed and a past value at a time point of a second period T2 (T2>T1) before the present value after a time point at which the position detecting unit has detected that the opening/closing member has moved the predetermined distance in the direction that the movement speed decreases.

In the present invention, an earlier value is selected as the past value of the rotation speed when the opening/closing member moves in a direction that the movement speed decreases and reaches a predetermined value, and the variation in the rotation speed is calculated using such past value, and thus a large speed variation can be obtained even if the movement speed of the opening/closing member becomes small by obtaining the variation in speed from the past value before the movement speed decreases and the present value. Therefore, when entrapment occurs near the fully closed position of the opening/closing member, the variation in speed reaches the threshold value and entrapment can be detected, thereby preventing the human body from being harmed. Furthermore, a troublesome work of dividing the moving region of the window into plurals and setting different threshold values for each region is eliminated, and thus can be easily realized.

The opening/closing member in the present invention is connected to a freely turning arm that moves in conjunction with the motor, and is movable in an up and down direction by turning of the arm; and the opening/closing member moves from a fully opened position to a fully closed position as the arm turns upward from a horizontal state. The variation calculating unit calculates the variation in the rotation speed using the past value at the time point of the second period before when the arm turns by a constant amount from the horizontal state and the opening/closing member moves by the predetermined distance and approaches the fully closed position.

The state detecting unit of the present invention may be a weight detecting unit for detecting a weight of a passenger. In this case, the variation calculating unit selects an earlier past value as the past value of the rotation speed when the weight of the passenger detected by the weight detecting unit is smaller than a predetermined value, and calculates the variation in the rotation speed using the past value and the present value. Accordingly, when a child entraps his/her hand, the variation in the rotation speed of the motor increases although the threshold value is unchanged, and thus entrapment can be reliably detected.

The state detecting unit of the present invention may be a temperature detecting unit for detecting a surrounding temperature of a vehicle body. In this case, the variation calculating unit selects an earlier past value or a past value closer to the present as the past value of the rotation speed when the surrounding temperature detected by the temperature detecting unit is a high temperature of higher than or equal to a predetermined value, and calculates the variation in the rotation speed using the past value and the present value. Furthermore, the variation calculating unit selects an earlier past value or a past value closer to the present as the past value of the rotation speed when the surrounding temperature detected by the temperature detecting unit is lower than a predetermined value, and calculates the variation in the rotation speed using the past value and the present value. Accordingly even if the surrounding temperature of the vehicle body is a high temperature or a low temperature, the variation in the rotation speed of the motor can be reduced thereby preventing mistaken judgment of entrapment.

The state detecting unit of the present invention may be a traveling road surface condition detecting unit for detecting the state of the traveling road surface. In this case, the variation calculating unit selects an earlier past value or a past value closer to the present as the past value of the rotation speed according to the state of the traveling road surface detected by the traveling road surface condition detecting unit, and calculates the variation in the rotation speed using the past value and the present value. Accordingly, when the traveling road surface is bad, the variation in the rotation speed of the motor is reduced thereby preventing mistaken judgment of entrapment.

The state detecting unit of the present invention may be an aged change detecting unit for detecting aged change. In this case, the variation calculating unit selects an earlier past value or a past value closer to the present as the past value of the rotation speed according to the aged change detected by the aged change detecting unit, and calculates the variation in the rotation speed using the past value and the present value. Accordingly, even if the movement speed of the window fluctuates between the fully closed position to the fully opened position due to the aged change, the variation in the rotation speed of the motor is reduced thereby preventing mistaken judgment of entrapment.

According to the present invention, entrapment can be accurately detected even if the movement speed of the opening/closing member fluctuates due to various factors, and furthermore, entrapment detection can be easily realized.

BRIEF DESCRIPTION OF THE DRAWINGS

FIG. 1 shows a block diagram of an electrical configuration of a power window device according to a first embodiment of the present invention;

FIG. 2 shows a schematic configuration view of one example of an operation switch;

FIG. 3 shows a view of one example of a window opening/closing mechanism;

FIG. 4 shows a view of a state in which an object is entrapped in a window;

FIG. 6 shows a graph of an example of temporal change in a motor rotation speed;

FIG. 13 shows a graph of an example of temporal change in a motor rotation speed;

DETAILED DESCRIPTION OF THE PREFERRED EMBODIMENTS

Figure 12:
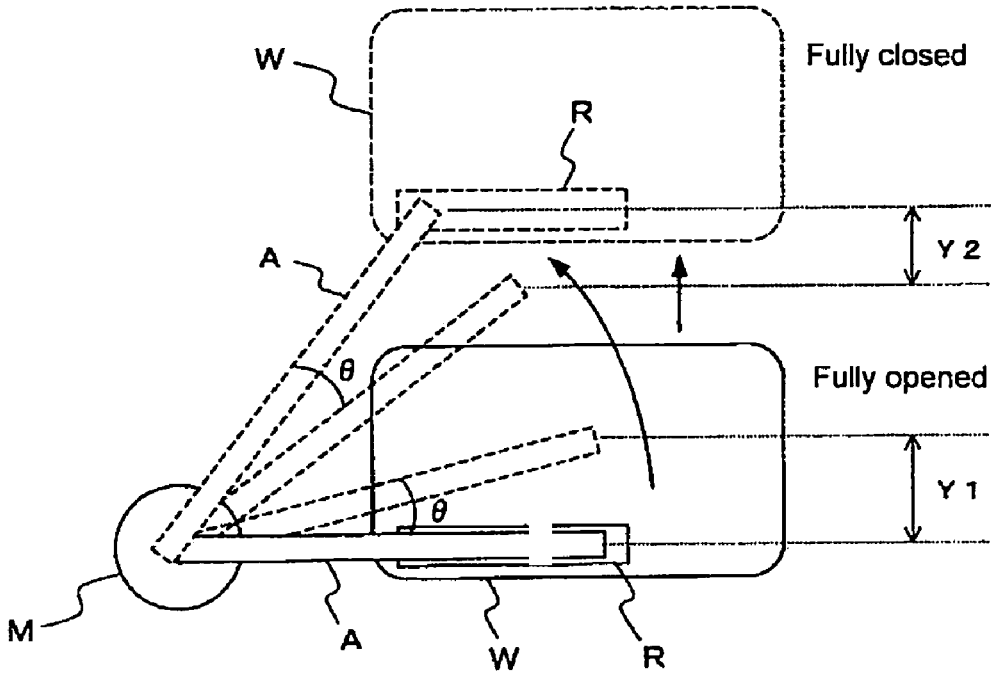
FIG. 12 shows a view describing a principle that movement speed of a window glass decreases near a fully closed position.

Embodiments of the present invention will now be described with reference to the drawings. FIGS. 1 to 4 described in the section of BACKGROUND OF THE INVENTION will be cited below. The content described in FIG. 12 is also applicable to the present invention.

FIG. 1 shows a block diagram of an electrical configuration of a power window device according to a first embodiment of the present invention. A control unit 1 including a CPU for controlling the opening/closing operation of the window, a motor drive circuit 2 for driving a motor 3, a rotary encoder 4 for outputting a pulse synchronized with the rotation of the motor 3, a pulse detection circuit 5 for detecting the pulse output from the rotary encoder 4, a memory 6 being configured by a ROM, a RAM, or the like, and an operation switch 7 for operating the opening/closing of the window. The threshold value β for detecting entrapment is stored in the memory 6. The rotary encoder 4 and the pulse detection circuit 5 are examples of a speed detecting unit and a position detecting unit in the present invention, and the control unit 1 is an example of variation calculating unit, judgment unit, and control unit in the present invention.

FIG. 2 shows an example of the operation switch 7 and FIG. 3 shows an example of the window opening/closing mechanism, but since they are already described above, redundant description will be omitted.

A principle of the present invention will now be described. The present invention is similar to a conventional art in that the variation Δf in pulse frequency is calculated from equation (1) based on the present value of the pulse frequency and the past value at the time point of a constant period before the present time, and judgment on entrapment is made by comparing the variation Δf with the threshold value β. However, in the conventional art, a period of going back to the past from the present is always the same (a=6 in the prior example) when obtaining the past value regardless of which position the window glass 101 is at between the fully closed position and the fully opened position, whereas in the present invention, the period of going back to the past from the present is differed between the time point until the window glass 101 reaches a predetermined position near the fully closed position of the window and the time point after reaching the predetermined position.

Figure 5:
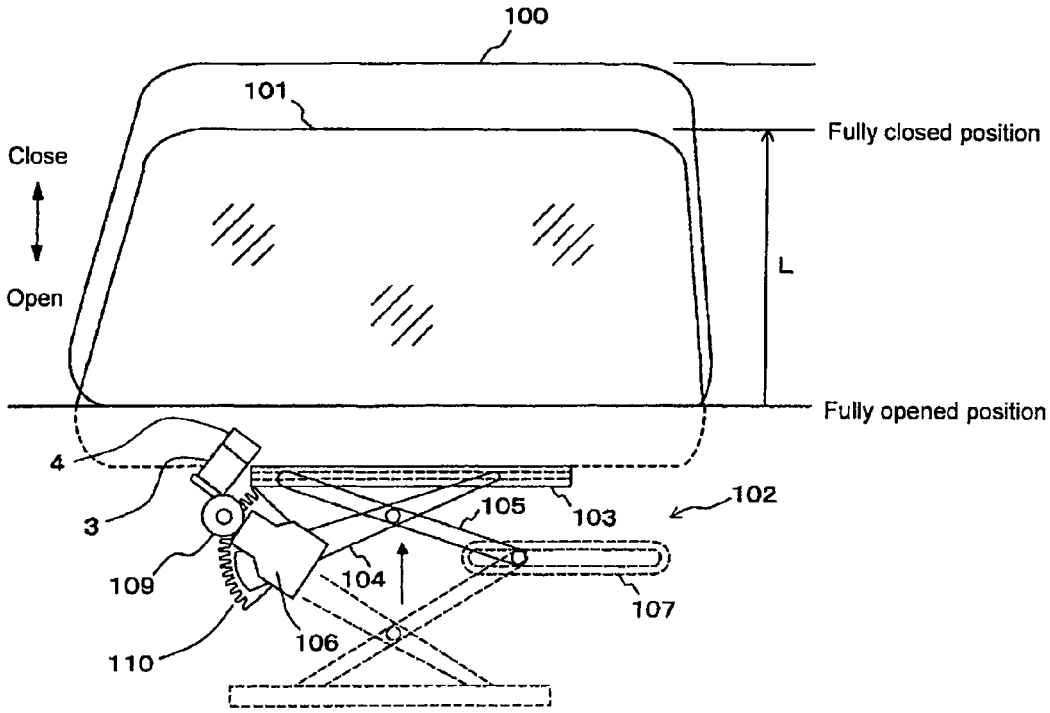
FIG. 5 shows a view describing a moved position of the window glass.

In other words, a=6 in equation (1) until the window glass 101 moves distance L from the fully opened position of the window in a closing direction (direction the movement speed decreases) in FIG. 5, where the pulse frequency at the time point of a period T1 corresponding to six timings before the present is used as the past value, and the variation Δf in pulse frequency is calculated from the past value and the present value. When the window glass 101 moves distance L in the closing direction and approaches the fully closed position of the window, a=11 in equation (1), where the pulse frequency at the time point of a period T2 (T2<T1) corresponding to eleven timings from the present is used as the past value, and the variation Δf in pulse frequency is calculated from the past value and the present value. The moved position of the window glass 101 can be detected based on the output pulse of the rotary encoder 4, but instead, a dedicated position detecting sensor may be separately arranged.

FIG. 6 shows a graph of temporal change in a motor rotation speed when a=11. The reference symbols in the figure are same as those described with FIG. 13, and thus redundant description will be omitted. In FIG. 6, assuming the present timing is t19, the pulse frequency at timing t8, which is eleven timings before the present time point, becomes the past value. The variation in pulse frequency in this case becomes $$\Delta f = f(8) - f(19)$$

which is a value larger than the variation in the above-described pulse frequency, which is 6 timings before t19

$$\Delta f = f(13) - f(19)$$

from FIG. 6. As a result, when entrapment occurred near the fully closed position of the window, that is, at the position the window glass 101 is raised by greater than or equal to the distance L in FIG. 5, the variation Δf2 does not reach the threshold value β and entrapment is not detected even at timing t19 if a=6, as described in FIG. 13, but the variation Δf2 in the pulse frequency reaches the threshold value β at timing t19 and entrapment is detected if a=11, as shown in FIG. 6.

Therefore, the variation in pulse frequency is calculated with a=6 in equation (1) until the window glass 101 moves distance L, and the variation in the pulse frequency is calculated with a=11 in equation (1) after the window glass 101 has moved distance L, so that even if entrapment occurred with the window glass 101 close to the window fully closed position, such entrapment can be accurately detected. If entrapment occurred with the window glass 101 near the window fully opened position, the variation Δf1 in pulse frequency reaches the threshold value β even with a=6 and entrapment is detected as described in FIG. 13. Consideration is made in having a=11 across the entire moving range of the window glass 102, but is not preferable since the rotation speed (pulse frequency) of the motor 3 actually fluctuates with time even if entrapment does not occur, and thus setting the value of a large without varying increases the error in the variation in speed. Therefore, the value of a is set large only near the window fully closed position at where the variation in speed is small and entrapment cannot be detected, as in the present invention, so that entrapment can be detected while having the error of variation in speed small. The value of a=6, a=11 described above is one example, and needles to say, the present invention is not limited thereto.

Figure 7:
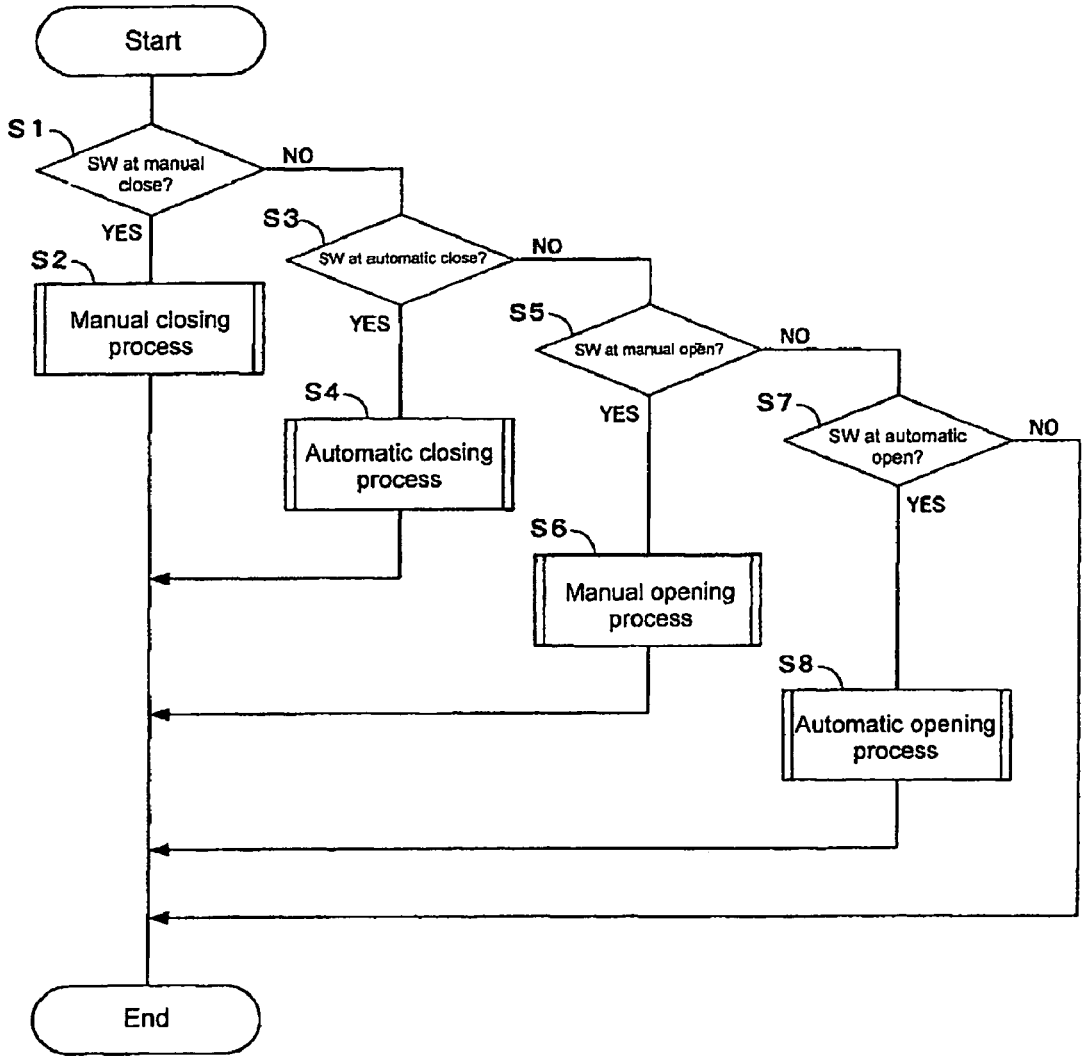
FIG. 7 shows a flowchart of basic operations of the power window device.

FIG. 7 shows a flowchart of basic operations of the power window device according to the embodiment of the present invention. "SW" in the figure represents the "operation switch 7" (same for subsequent flowcharts). If the operation switch 7 is at the manual close MC position in step S1, a process of manual closing operation is performed (step S2); if the operation switch 7 is at the automatic close AC position in step S3, a process of automatic closing operation is performed (step S4); if the operation switch 7 is at the manual open MO position in step S5, a process of the manual opening operation is performed (step S6); and if the operation switch is at the automatic open AO position in step S7, a process of automatic opening operation is performed (step S8). If the operation switch is not at the automatic open AO position in step S7, the operation switch 7 is at the neutral N position, and no process is performed. The details of steps S2, S4, S6, and S8 will be sequentially described below.

Figure 8:
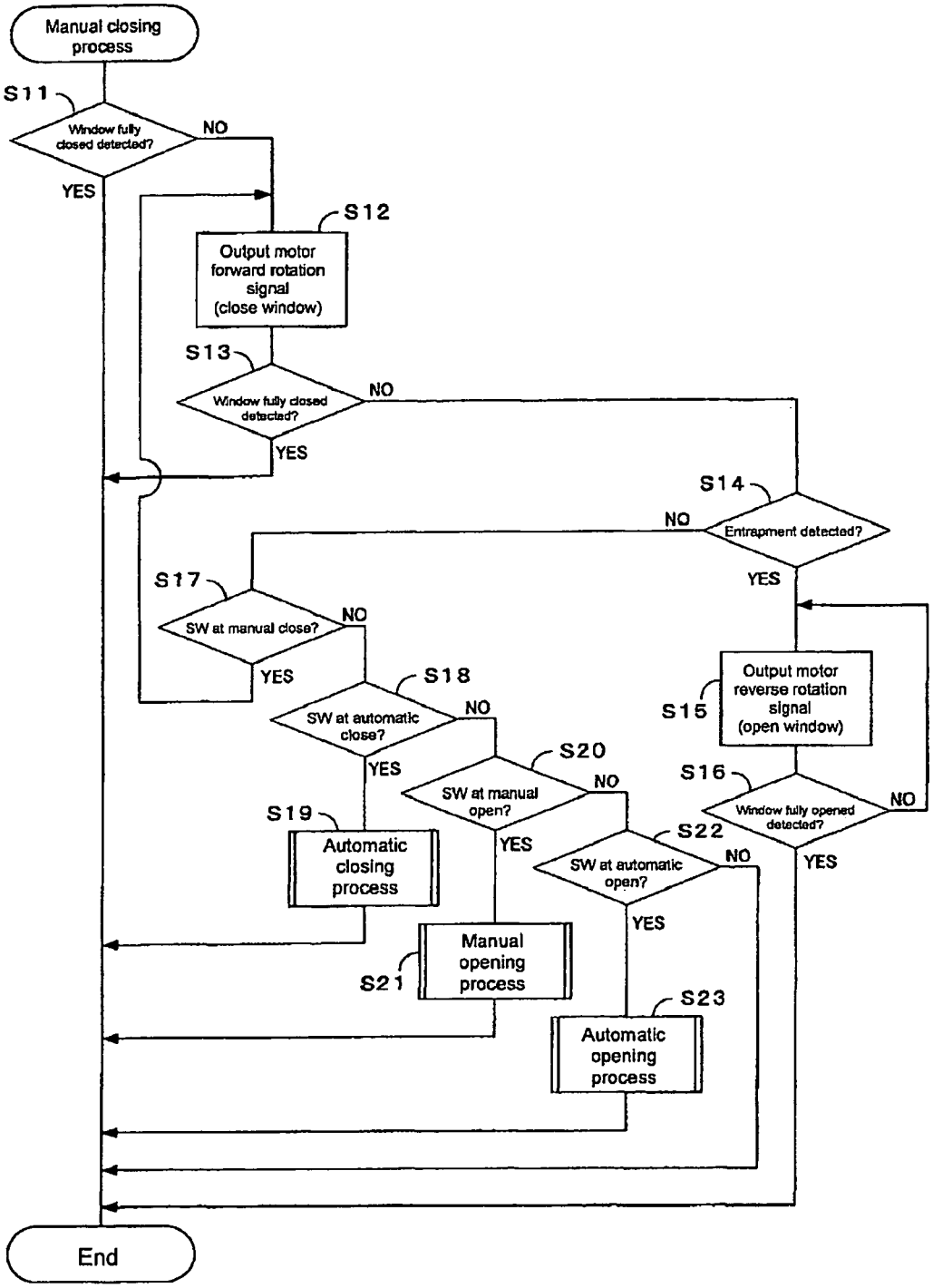
FIG. 8 shows a flowchart of a detailed procedure of a manual closing process.

FIG. 8 shows a detailed procedure of "manual closing process" in step S2 of FIG. 7. This processing procedure is no different from the conventional art. The procedure of FIG. 8 is executed by the CPU configuring the control unit 1. First, whether or not the window 100 is fully closed by the manual closing operation is judged based on an output of the rotary encoder 4 (step S11). If the window 100 is fully closed (step S11: YES), the process ends and if the window 100 is not fully closed (step S11: NO), a forward rotation signal is output from the motor drive circuit 2 to forward rotate the motor 3 and close the window 100 (step S12). Subsequently, whether or not the window 100 is fully closed is judged (step 513), where if the window 100 is fully closed (step S13: YES), the process ends, and if the window 100 is not fully closed (step S13: NO), whether or not entrapment is detected is judged (step S14). In detecting entrapment, the variation Δf in pulse frequency obtained in equation (1) is compared with the threshold value β, as described above, where judgment is made that entrapping has occurred if Δt≧β. In this case, the variation Δf1 is obtained with a=6, and such variation is compared with the threshold value β. In the case of the manual closing operation, there is no need to separately use a=6 and a=11 since the window glass can be stopped by stopping the operation of the operation switch 7 even if entrapment has occurred, and the window glass is not forcibly closed as with the case of automatic closing operation. Obviously, the present invention can be used in the manual closing operation.

When an object Z is entrapped as shown in FIG. 4 (step S14: YES), a reverse rotation signal is output from the motor drive circuit 2 to reverse rotate the motor 3 and open the window 100 (step S15). The entrapment is thereby released. Whether or not the window 100 is fully opened is judged (step S16), where if the window 100 is fully opened (step S16: YES), the process ends and if the window 100 is not fully opened (step S16: NO), the process returns to step S15 to continue the reverse rotation of the motor 3. Instead of opening the window 100 by reverse rotating the motor 3, the motor 3 may be stopped so that the window 100 does not further close.

If entrapment is not detected in step S14 (step S14: NO), whether or not the operation switch 7 is at the manual close MC position is judged (step S17). If the operation switch 7 is at the manual close MC position (step S17: YES), the process returns to step S12 to continue the forward rotation of the motor 3, and if the operation unit 7 is not at the manual close MC operation (step S17: NO), whether or not the operation switch 7 is at the automatic close AC position is judged (step S18). If the operation switch 7 is at the automatic close AC position (step S18: YES), the process proceeds to the automatic closing process (step S19) to be hereinafter described (FIG. 9), and if the operation switch 7 is not at the automatic close AC position (step S18: NO), whether or not the operation switch 7 is at the manual open MO position is judged (step S20). If the operation switch 7 is at the manual open MO position (step S20: YES), the process proceeds to the manual opening process (step S21) to be hereinafter described (FIG. 10), and if the operation switch 7 is not at the manual open MO position (step S20: NO), whether or not the operation switch 7 is at the automatic open AO position is judged (step S22). If the operation switch 7 is at the automatic open AO position (step S22: YES), the process proceeds to the automatic opening process (step S23) to be hereinafter described (FIG. 11), and if the operation switch 7 is not at the automatic open AO position (step S22: NO), no process is performed and the process ends.

Figure 9:
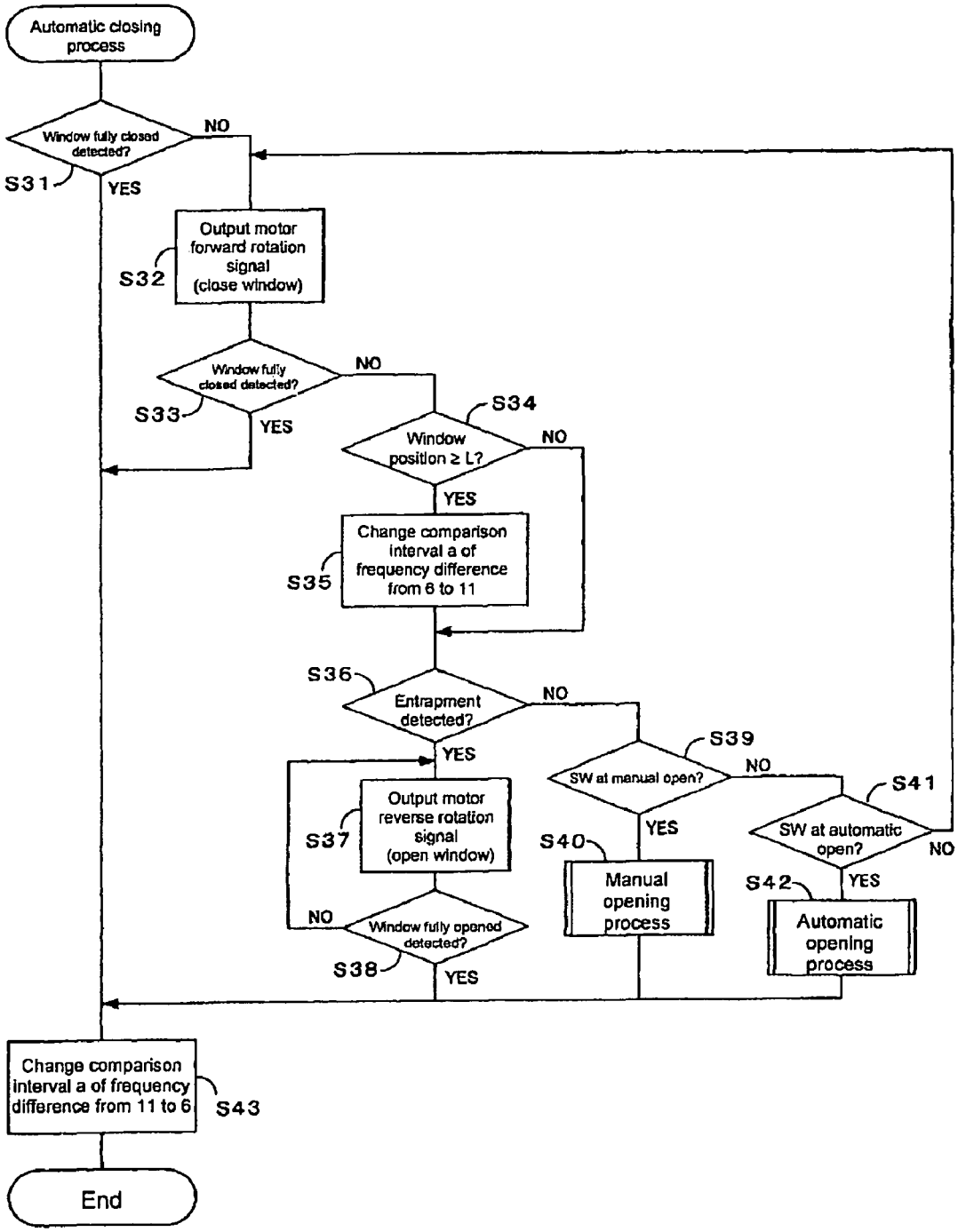
FIG. 9 shows a flowchart of a detailed procedure of an automatic closing process.

FIG. 9 shows a detailed procedure of "automatic closing process" in step S4 of FIG. 7. The processing procedure (in particular, steps S34, S35) is a feature of the present invention. The procedure of FIG. 9 is executed by the CPU configuring the control unit 1. First, whether or not the window 100 is fully closed by the automatic closing operation is judged based on the output of the rotary encoder 4 (step S31). If the window 100 is fully closed (step 31; YES), the process proceeds to step S43, and if the window 100 is not fully closed (step S31: NO), the process proceeds to step S32.

In step S32, the forward rotation signal is output to the motor drive circuit 2 to forward rotate the motor 3 and close the window 100. Thereafter, whether or not the window 100 is fully closed is judged (step S33), where if the window 100 is fully closed (step S33: YES), the process proceeds to step S34, and if the window is not fully closed (step S33: NO), the process proceeds to step S34, and whether or not the window glass 101 has moved (risen) to the position of distance L of FIG. 5 is judged. If the window glass 101 has not moved to the position of distance L (step S34: NO), step S35 is skipped, and the process proceeds to step S36. If the window glass 101 has moved to the position of distance L (step S34: YES), the process proceeds to step S35 at where the comparison interval a of the frequency difference is changed from a=6 (initial value) to a=11, and the process proceeds to step S36.

In step S36, whether or not entrapping is detected is judged. In detecting entrapment, the variation $\Delta f$ in pulse frequency obtained in equation (1) is compared with the threshold value $\beta$, and judgment is made that entrapment has occurred if $\Delta f \geqq \beta$. In this case, if the judgment of step S34 is NO, the variation $\Delta f$ obtained with a=6 and the threshold value $\beta$ are compared, and if the judgment of step S34 is YES, the variation $\Delta f$ obtained with a=11 and the threshold value $\beta$ are compared.

If entrapment is found as a result of the judgment (step S36: YES), the reverse signal is output from the motor drive circuit 2 to reverse rotate the motor 3 and open the window 100 (step S27). The entrapment is thereby released. Whether or not the window 100 is fully opened is judged (step S38), where if the window 100 is fully opened (step S38: YES), the process proceeds to steps 43, and if the window 100 is not fully opened (step S38: NO), the process returns to step S37 to continue the reverse rotation of the motor 3. Instead of opening the window 100 by reverse rotating the motor 3, the motor 3 may be stopped so that the window 100 does not further close.

If entrapment is not detected in step S36 (step S36: NO), whether or not the operation switch 7 is at the manual open MO position is judged (step S39). If the operation switch 7 is at the manual open MO position (step S39: YES), the process proceeds to the manual opening process (step S40) to be hereinafter described (FIG. 10), and if the operation unit 7 is not at the manual open operation (step S39: NO), whether or not the operation switch 7 is at the automatic open AO position is judged (step S41). If the operation switch 7 is at the automatic open position (step S41: YES), the process proceeds to the automatic opening process (step S42) to be hereinafter described (FIG. 11), and if the operation switch 7 is not at the automatic open AO position (step S41: NO), the process returns to step S32 to continue the automatic closing operation.

When the judgment in steps S31, S33, S38 is YES and also after the execution of steps S40 and S42, the process proceeds to step S43 at where the comparison interval a of the frequency difference is changed from 11 to 6, the initial value.

Figure 10:
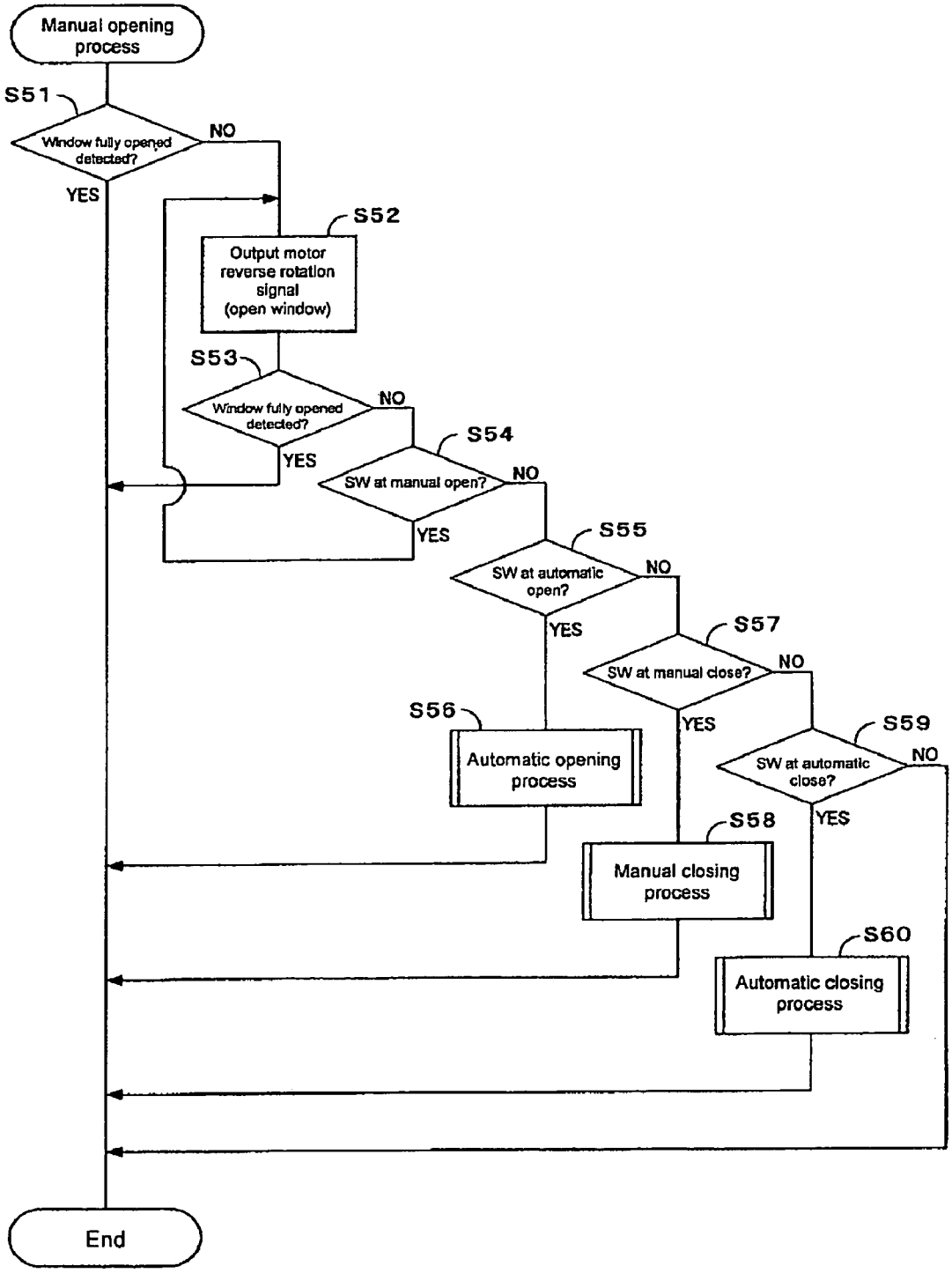
FIG. 10 shows a flowchart of a detailed procedure of a manual opening process.

FIG. 10 shows a detailed procedure of "manual opening process" in step S6 of FIG. 7. This processing procedure is no different from the conventional art. The procedure of FIG. 10 is executed by the CPU configuring the control unit 1. First, whether or not the window 100 is fully opened by the manual opening operation is judged based on the output of the rotary encoder 4 (step S51). If the window 100 is fully opened (step S51: YES), the process ends, and if the window 100 is not fully opened (step S51: NO), the reverse rotation signal is output from the motor drive circuit 2 to reverse rotate the motor 3 and open the window 100 (step S52). Subsequently, whether or not the window 100 is fully opened is judged (step S53), where if the window 100 is fully opened (step S53: YES), the process ends and if the window 100 is not fully opened (step S53: NO), whether or not the operation switch 7 is at the manual open MO position is judged (step S54). If the operation switch 7 is at the manual open MO position (step S54: YES), the process returns to step S52 to continue the reverse rotation of the motor 3, and if the operation switch 7 is not at the manual open MO position (step S54: MO), whether or not the operation switch is at the automatic open AO position is judged (step S55). If the operation switch 7 is at the automatic open AO position (step S55: YES), the process proceeds to an automatic opening process (step S56) to be hereinafter described (FIG. 11), and if the operation switch 7 is not at the automatic open AO position (step S55: NO), whether or not the operation switch 7 is at the manual close MC position is judged (step S57). If the operation switch 7 is at the manual close MC position (step S57: YES), the process proceeds to the manual closing process (step S58) described above (FIG. 8), and if the operation switch 7 is not at the manual close MC position (step S57: NO), whether or not the operation switch 7 is at the automatic close AC position is judged (step S59). If the operation switch 7 is at the automatic close AC position (step S59; YES), the process proceeds to the automatic closing process (FIG. 60) described above (FIG. 9), and if the operation switch 7 is not at the automatic close AC position (step S59: NO), no process is performed and the process ends.

Figure 11:
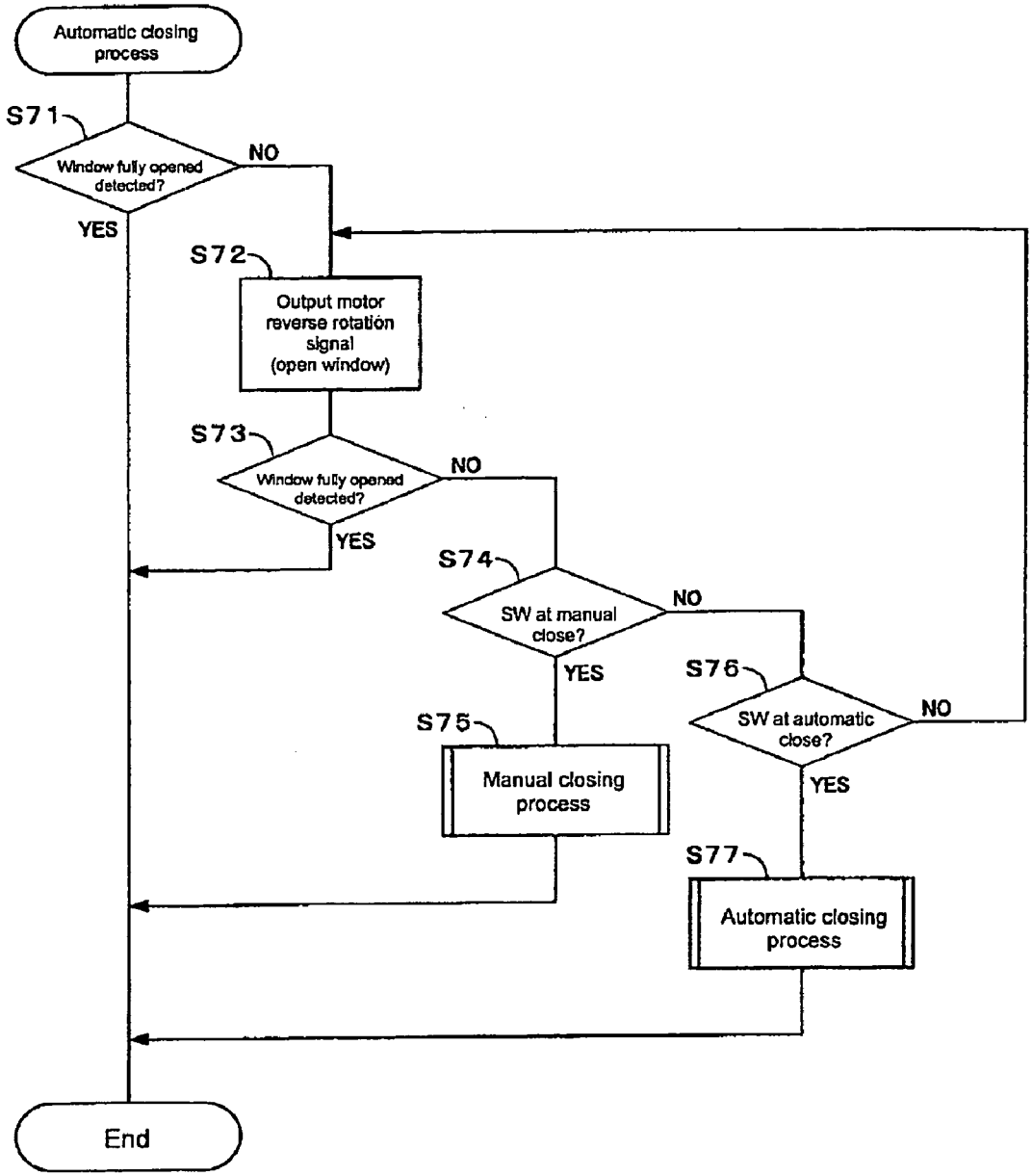
FIG. 11 shows a flowchart of a detailed procedure of an automatic opening process.

FIG. 11 shows a detailed procedure of "automatic opening process" in step S8 of FIG. 7. This processing procedure is no different from the conventional art. The procedure of FIG. 11 is executed by the CPU configuring the control unit 1. First, whether or not the window 100 is fully opened by the automatic opening operation is judged based on the output of the rotary encoder 4 (step S71). If the window 100 is fully opened (step S71: YES), the process ends, and if the window 100 is not fully opened (step S71: NO), the reverse rotation signal is output from the motor drive circuit 2 to reverse rotate the motor 3 and open the window 100 (step S72). Subsequently, whether or not the window 100 is fully opened is judged (step S73), where if the window 100 is fully opened (step S73: YES), the process ends and if the window 100 is not fully opened (step S73: NO), whether or not the operation switch 7 is at the manual close MC position is judged (step S74). If the operation switch 7 is at the manual close MC position (step S74: YES), the process proceeds to the manual closing process (step S75) described above (FIG. 8), and if the operation switch 7 is not at the manual close MC position (step S74: MO), whether or not the operation switch is at the automatic close AC position is judged (step S76). If the operation switch 7 is at the automatic close AC position (step S76: YES), the process proceeds to the automatic closing process (step S77) described above (FIG. 9), and if the operation switch 7 is not at the automatic close AC position (step S76: NO), the process returns to step S72 to continue the reverse rotation of the motor 3.

Therefore, in the first embodiment described above, when the moved distance in the closing direction of the window glass 101 reaches L, an earlier past value is selected as the past value of the rotation speed (pulse frequency) of the motor 3, and the variation in rotation speed is calculated using such past value. Therefore, a large variation in speed is obtained even if the movement speed of the window glass 101 decreases by obtaining the variation in speed from the past value before the movement speed decreases (t1 to t9 of FIG. 6) and the present value. Thus, when entrapment occurs near the fully closed position of the window, the variation in speed A2 reaches the threshold value β and the entrapment can be detected, whereby the human body is prevented from being harmed. Furthermore, no troublesome work of setting different threshold values for every window moving region divided into plurals as in Japanese Patent Publication No. 2857048 needs to be performed, and can be easily realized.

Figure 14:
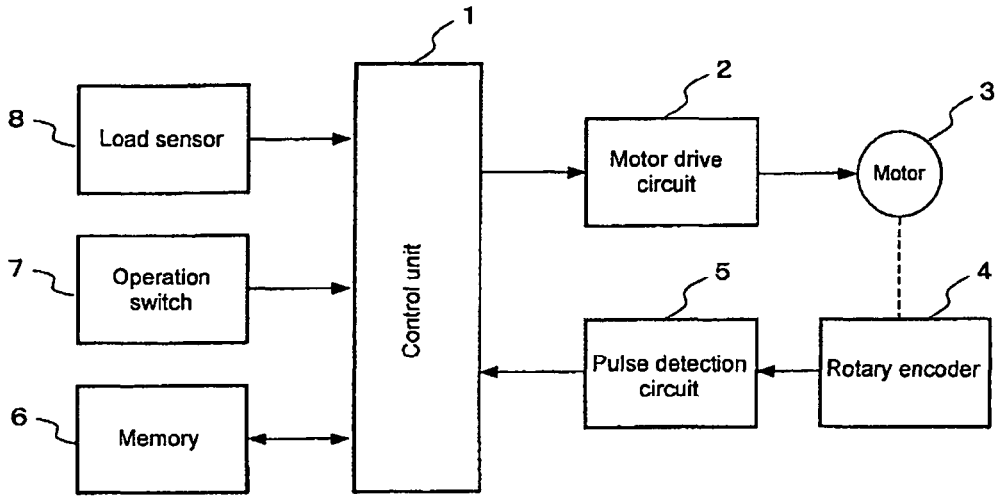
FIG. 14 shows a block diagram of an electrical configuration of a power window device according to a second embodiment of the present invention.

FIG. 14 shows a block diagram of an electrical configuration of a power window device according to a second embodiment of the present invention. In FIG. 14, a load sensor 8 is arranged in addition to the configuration of FIG. 1. Since other configuration is the same as FIG. 1, same reference symbols are denoted for portions same as in FIG. 1, and the description thereof will be omitted. The load sensor 8 is an example of a weight detecting unit in the present invention arranged in the seat of the vehicle to detect the weight of the passenger when seated. A known sensor as disclosed in Japanese Laid-Open Patent Publication No. 2005-231539 can be used for the load sensor 8.

Figure 15:
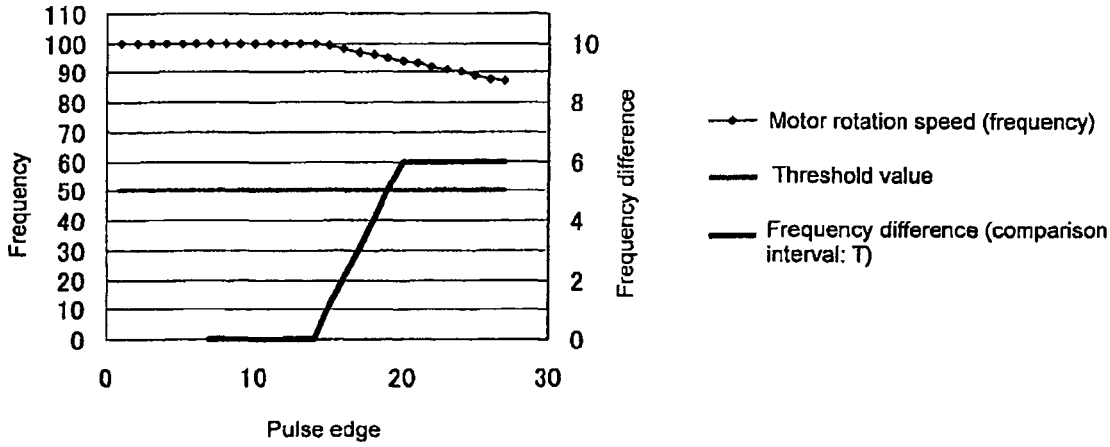
FIG. 15 shows a graph of change in a motor rotation speed when the hand of an adult is entrapped in the window.
Figure 16:
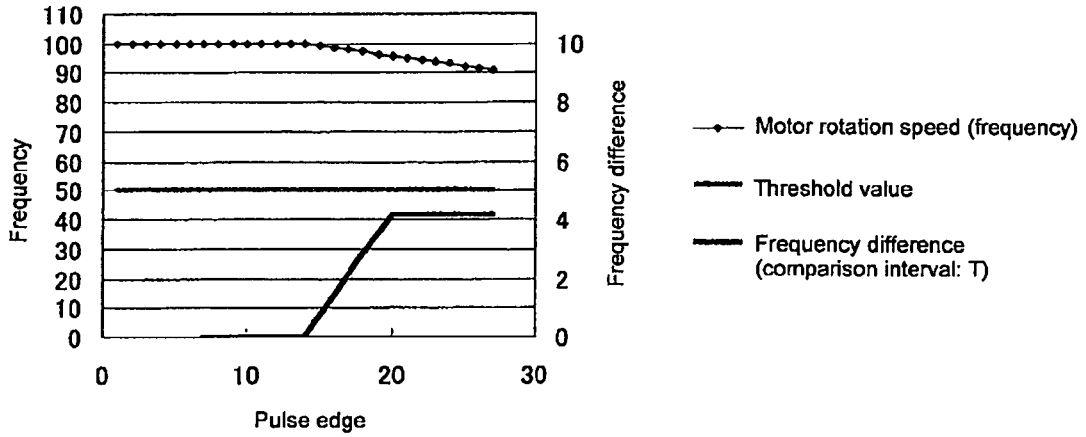
FIG. 16 shows a graph of change in a motor rotation speed when the hand of a child is entrapped in the window.

FIG. 15 shows a graph of change in rotation speed of the motor 3 when the hand of an adult is entrapped in the window. FIG. 16 shows a graph of change in rotation speed of the motor 3 when the hand of a child is entrapped in the window. The vertical axis of each figure indicates the frequency (unit: Hz) corresponding to the motor rotation speed and the difference (unit: Hz) in frequency, and the horizontal axis indicates number of pulse edges corresponding to time. In each figure, the comparison interval T of the frequency difference is T=6. In other words, the frequency difference is calculated as the difference between the present frequency and the past value, which is six values before the present frequency. T is the same as a in equation (1) previously described. T=6 is an example, and is not limited thereto.

As apparent from comparing FIG. 15 and FIG. 16, since the bone structure or the like of the hand of the adult is harder than that of the hand of the child, the rotation speed (frequency) of the motor shows large decreasing tendency in time of entrapment when the hand of the adult is entrapped (FIG. 15). Therefore, the difference value of the frequency exceeds the threshold value, and judgment is made that entrapment has occurred. Since the bone structure of the hand of the child is softer than that of the hand of the adult, the rotation speed (frequency) of the motor shows gradual decreasing tendency in time of entrapment when the hand of the child is entrapped (FIG. 16). Therefore, the difference value of the frequency saturates before reaching the threshold value and becomes a constant value, whereby judgment that entrapment has occurred may not be made although entrapment has occurred.

Figure 17:
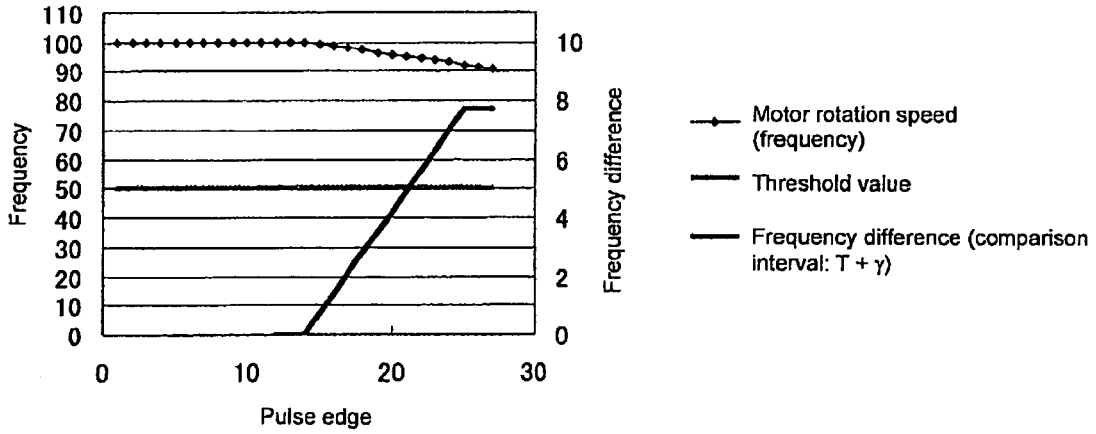
FIG. 17 shows a graph in which a comparison interval of the frequency difference is changed.

In the present embodiment, if the weight of the passenger detected by the load sensor 8 is smaller than a predetermined value (e.g., when detected load is 7 N/mm), the control unit 1 judges that the passenger seated on the relevant seat is a child, and thus changes the comparison interval from T to T+γ, and calculates the frequency difference. FIG. 17 shows a graph of change in frequency difference when T=6 and γ=5. In this case, the frequency difference is calculated as the difference between the present frequency and the past value, which is eleven values before the present frequency. The value of γ=5 is also an example, and is not limited thereto. Therefore, when detected that the passenger is a child, the earlier past value is selected as the past value of the frequency (i.e., rotation speed), and the frequency difference (i.e., variation in rotation speed) is calculated using the past value and the present value, whereby the frequency difference becomes larger and exceeds the threshold value even if the decreasing degree of the motor rotation speed in time of entrapment is small, as shown in FIG. 17, and occurrence of entrapment is reliably detected.

Figure 18:
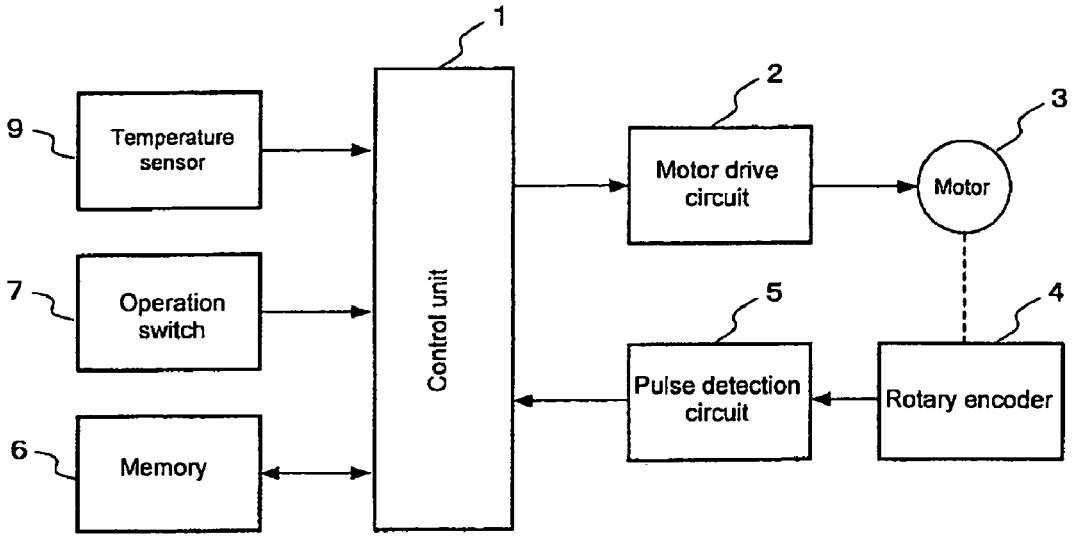
FIG. 18 shows a block diagram of an electrical configuration of a power window device according to a third embodiment of the present invention.

FIG. 18 shows a block diagram of an electrical configuration of a power window device according to a third embodiment of the present invention. In FIG. 18, a temperature sensor 9 is arranged in addition to the configuration of FIG. 1. Since other configuration is the same as FIG. 1, same reference symbols are denoted for portions same as in FIG. 1, and the description thereof will be omitted. The temperature sensor 9 is an example of a temperature detecting unit in the present invention that is arranged at an appropriate region of the vehicle body so that a temperature of a vehicle surrounding can be measured. A known sensor can be used for the temperature sensor 9.

Figure 23:
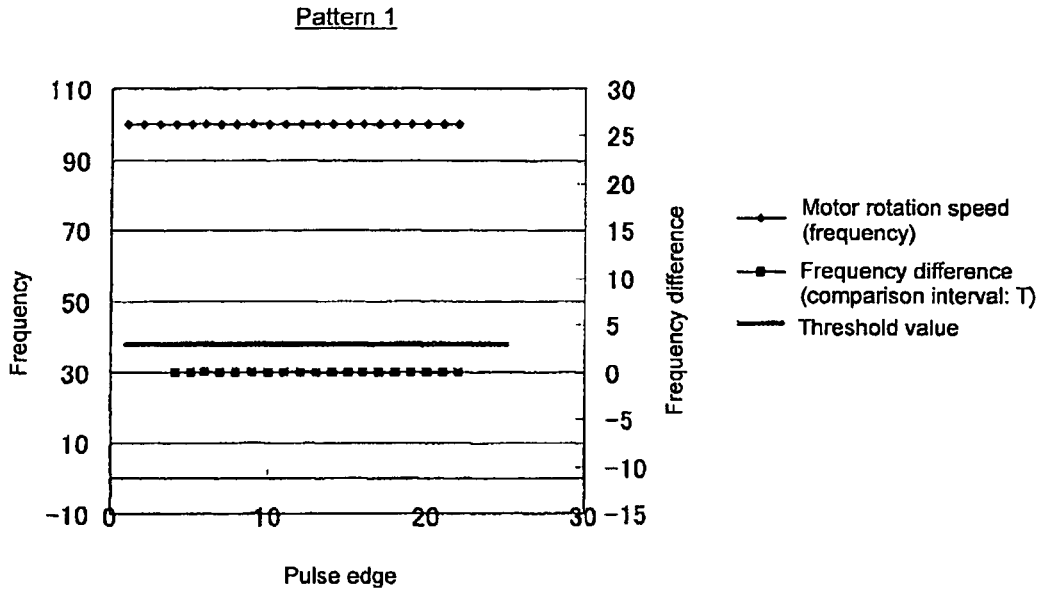
FIG. 23 shows a graph of a characteristic (pattern 1) of a motor rotation speed.

If the temperature of the vehicle surrounding is normal temperature, the rotation speed of the motor 3 when entrapment has not occurred has a pattern shown in FIG. 23. A pattern of FIG. 23 is hereinafter referred to as "pattern 1". As in FIG. 23, the rotation speed of the motor 3 is constant at normal temperature, and the difference value of the frequency will not exceed the threshold value. Thus, mistaken judgment of entrapment obviously does not occur.

Figure 24:
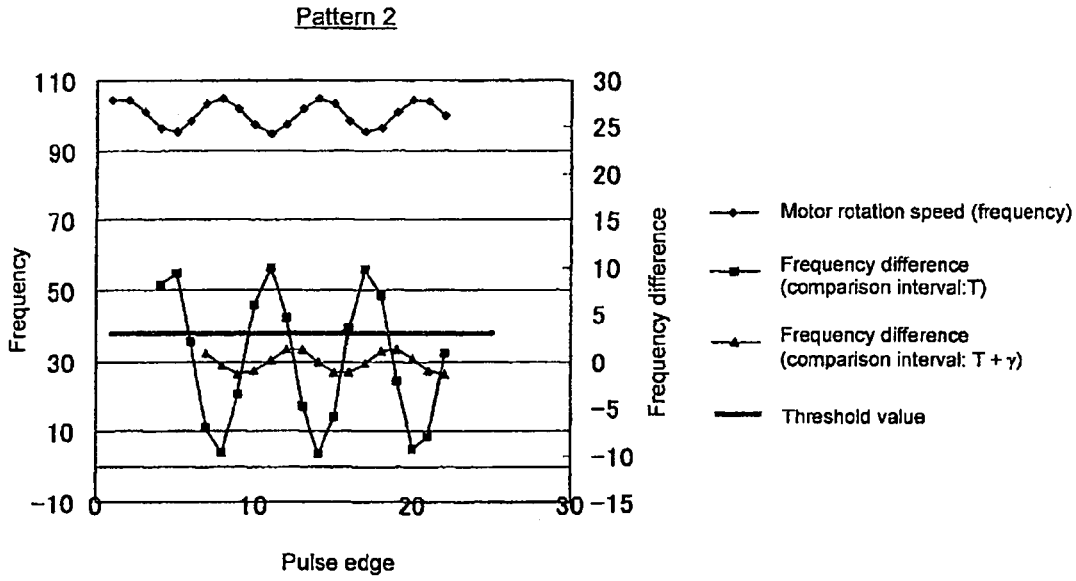
FIG. 24 shows a graph of a characteristic (pattern 2) of a motor rotation speed.

When the temperature of the vehicle surrounding becomes a high temperature, the rotation speed of the motor 3 is not constant although entrapment has not occurred and is experimentally found to have a characteristic of fluctuating as in FIG. 24. A pattern of FIG. 24 is referred to as "pattern 2". In FIG. 24, the frequency difference (indicated with ■) when the comparison interval is T (T=3 herein) becomes larger and exceeds the threshold value due to sinusoidal fluctuation of the motor rotation speed, and mistaken judgment that entrapment has occurred is made although entrapment has not occurred.

Therefore, in the present embodiment, the control unit 1 changes the comparison interval from T to T+γ and calculates the frequency difference when the temperature of the vehicle surrounding detected by the temperature sensor 9 is a high temperature which is higher than or equal to a predetermined value. In FIG. 24, T=3 and γ=3, and the frequency difference (indicated with ▲) is calculated as the difference between the present frequency and the past value, which is six values before the present frequency. Thus, when detected that the surrounding temperature is a high temperature, the earlier past value is selected as the past value of the frequency (i.e., rotation speed), and the frequency difference (i.e., variation in rotation speed) is calculated using the past value and the present value, whereby the frequency difference becomes small and does not exceed the threshold value even if the fluctuation of the motor rotation speed becomes larger, and judgment that entrapment has occurred is not made thereby preventing mistaken judgment.

Figure 25:
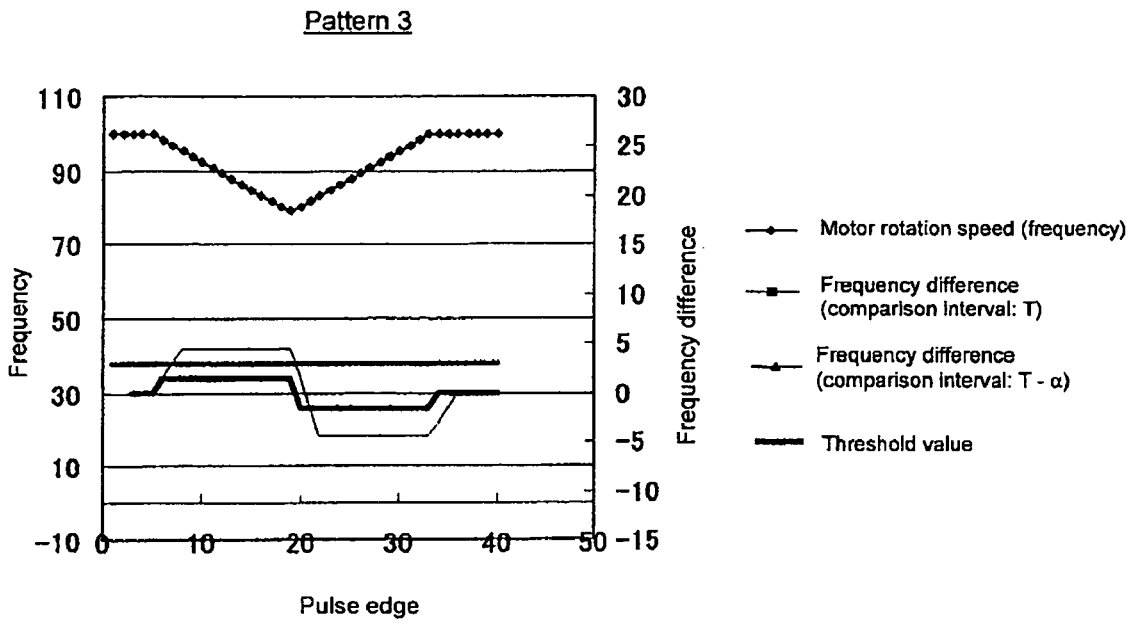
FIG. 25 shows a graph of a characteristic (pattern 3) of a motor rotation speed.

When the temperature of the vehicle surrounding becomes a low temperature, the rotation speed of the motor 3 is not constant although the entrapment has not occurred and is experimentally found to have a characteristic of decreasing once before the window becomes fully closed from fully opened as in FIG. 25, and increasing thereafter. A pattern of FIG. 25 is hereinafter referred to as "pattern 3". In FIG. 25, the frequency difference (indicated with thin solid line) when the comparison interval is T (T=3 herein) increases and exceeds the threshold value due to V-shaped fluctuation of the motor rotation speed, and thus mistaken judgment that entrapment has occurred is made although entrapment has not occurred.

Therefore, in the present embodiment, the control unit 1 changes the comparison interval from T to T−α and calculates the frequency difference when the temperature of the vehicle surrounding detected by the temperature sensor 9 is a low temperature of lower than a predetermined value. In FIG. 25, T=3 and α=1, and the frequency difference (indicated with thick solid line) is calculated as the difference between the present frequency and the past value, which is two values before the present frequency. Thus, when detected that the surrounding temperature is a low temperature, the past value closer to the present is selected as the past value of the frequency (i.e., rotation speed), and the frequency difference (i.e., variation in rotation speed) is calculated using the past value and the present value, whereby the frequency difference becomes small and does not exceed the threshold value even if the fluctuation of the motor rotation speed becomes larger, and judgment that entrapment has occurred is not made thereby preventing mistaken judgment.

In FIG. 24, the earlier past value is selected with the comparison interval as T+γ, and in FIG. 25, the past value closer to the present is selected with the comparison interval as T−α, but in principle, the comparison interval may be T−α in FIG. 24, and the comparison interval may be T+γ in FIG. 25. The values of T, α, and γ are suitably selected according to the motor characteristics.

Figure 19:
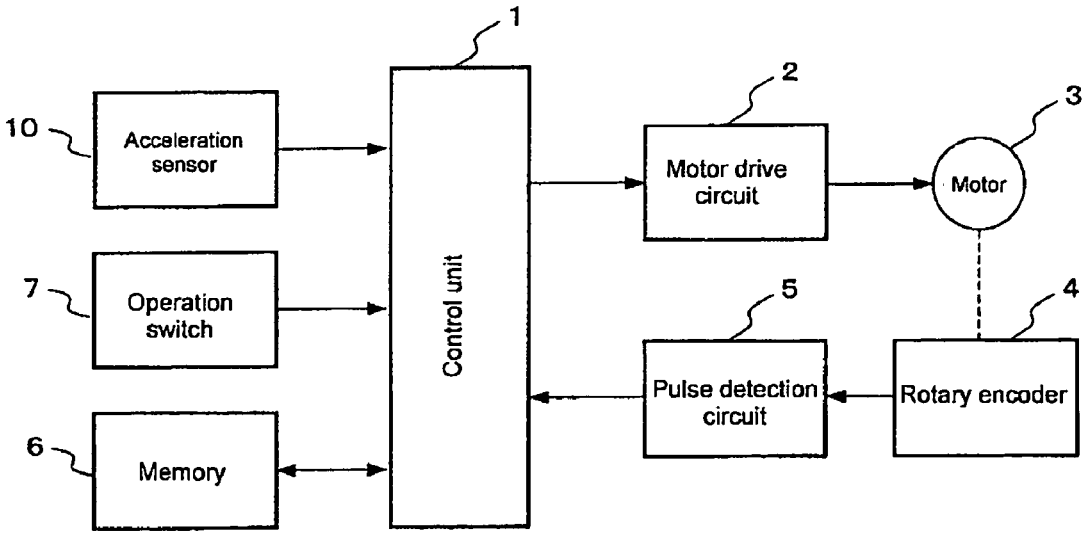
FIG. 19 shows a block diagram of an electrical configuration of a power window device according to a fourth embodiment of the present invention.

FIG. 19 shows a block diagram of an electrical configuration of a power window device according to a fourth embodiment of the present invention. In FIG. 19, an acceleration sensor 10 is arranged in addition to the configuration of FIG. 1. Since other configuration is the same as FIG. 1, same reference symbols are denoted for portions same as in FIG. 1, and the description thereof will be omitted. The acceleration sensor 10 is an example of a traveling road surface condition detecting unit in the present invention that is arranged at an appropriate region of the vehicle body so that an acceleration applied to the vehicle when traveling a bad road can be measured. A known sensor can be used for the acceleration sensor 10.

If a road surface on which the vehicle is traveling is a flatland, the rotation speed of the motor 3 when entrapment has not occurred is the previously described pattern 1 (FIG. 23). When traveling a flatland, the rotation speed (frequency) of the motor 3 is constant and the difference value of the frequency does not exceed the threshold value. Therefore, mistaken judgment of entrapment obviously does not occur.

If the road surface on which the vehicle is traveling is a bad road (unpaved gravel road, bumpy road and the like), the rotation speed of the motor 3 is not constant although entrapment has not occurred, and is experimentally found to be the previously described pattern 2 (FIG. 24). Thus, as described in FIG. 24, the frequency difference becomes larger and exceeds the threshold value, and mistaken judgment that entrapment has occurred is made although entrapment has not occurred.

In the present embodiment, the control unit 1 judges that the traveling road surface of the vehicle is a bad road, changes the comparison interval from T to T+γ when the detected acceleration value of the acceleration sensor 10 is greater than or equal to a predetermined value, and then calculates the frequency difference using the earlier past value, similar to the third embodiment. The frequency difference thus becomes small and does not exceed the threshold value even if the fluctuation of the motor rotation speed is large, and thus judgment that entrapment has occurred is not made thereby preventing mistaken judgment.

The earlier past value is selected with the comparison interval as T+γ, but in principle, the past value closer to the present can be selected with the comparison interval as T−α. The values of T, α, and γ are suitably selected according to the motor characteristics. In FIG. 19, the acceleration sensor 10 is used for the traveling road surface condition detecting unit, but an imaging device for imaging the road surface may be used instead of the acceleration sensor 10 to detect the bad road by image processing.

A case in which mistaken judgment of entrapment occurs before being judged as bad road is considered, which is responded with a method of monitoring whether or not the frequency difference exceeds the threshold value for greater than or equal to a constant number of times (e.g., three times) within a constant period and making the judgment that entrapment has occurred if the threshold value is exceeded.

Figure 20:
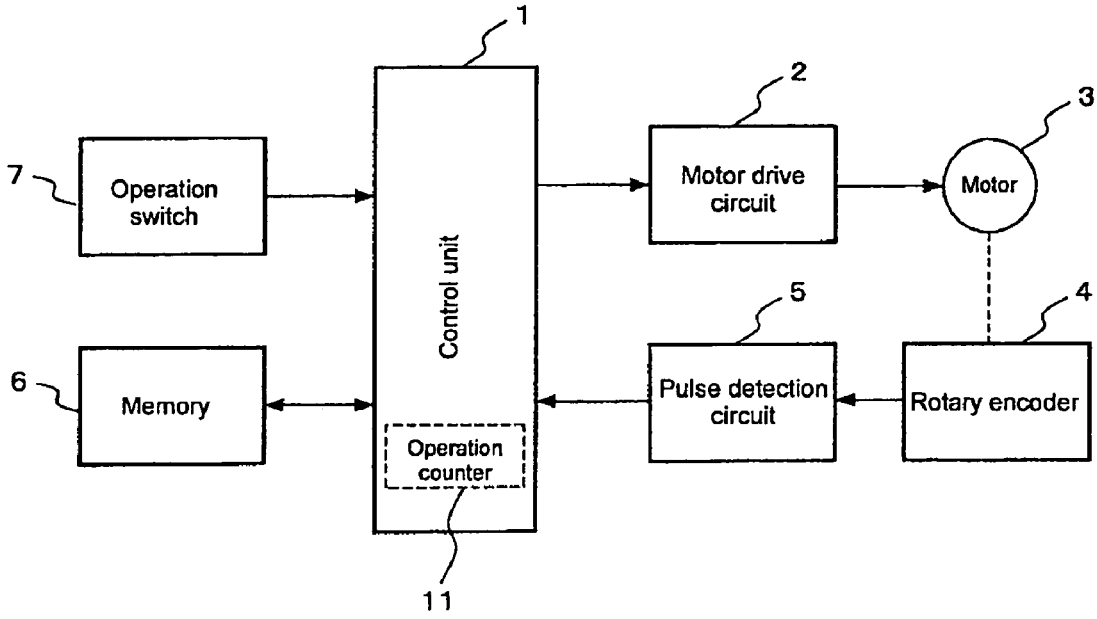
FIG. 20 shows a block diagram of an electrical configuration of a power window device according to a fifth embodiment of the present invention.

FIG. 20 shows a block diagram of an electrical configuration of a power window device according to a fifth embodiment of the present invention. In FIG. 20, an operation counter 11 is arranged in addition to the configuration of FIG. 1. Since other configuration is the same as FIG. 1, same reference symbols are denoted for portions same as in FIG. 1, and the description thereof will be omitted. The operation counter 11 is an example of an aged change detecting unit in the present invention. An initial value of the operation counter 11 is set to 0 in time of factory shipment, and the counter value is added by +1 every time the opening and closing operation of the window is performed by the operation switch 7.

If days have passed from when the vehicle is bought, the rotation speed of the motor 3 when entrapment has not occurred is the previously described pattern 1 (FIG. 23). The rotation speed (frequency) of the motor 3 is constant and the difference value of the frequency does not exceed the threshold value. Therefore, mistaken judgment of entrapment obviously does not occur.

Figure 26:
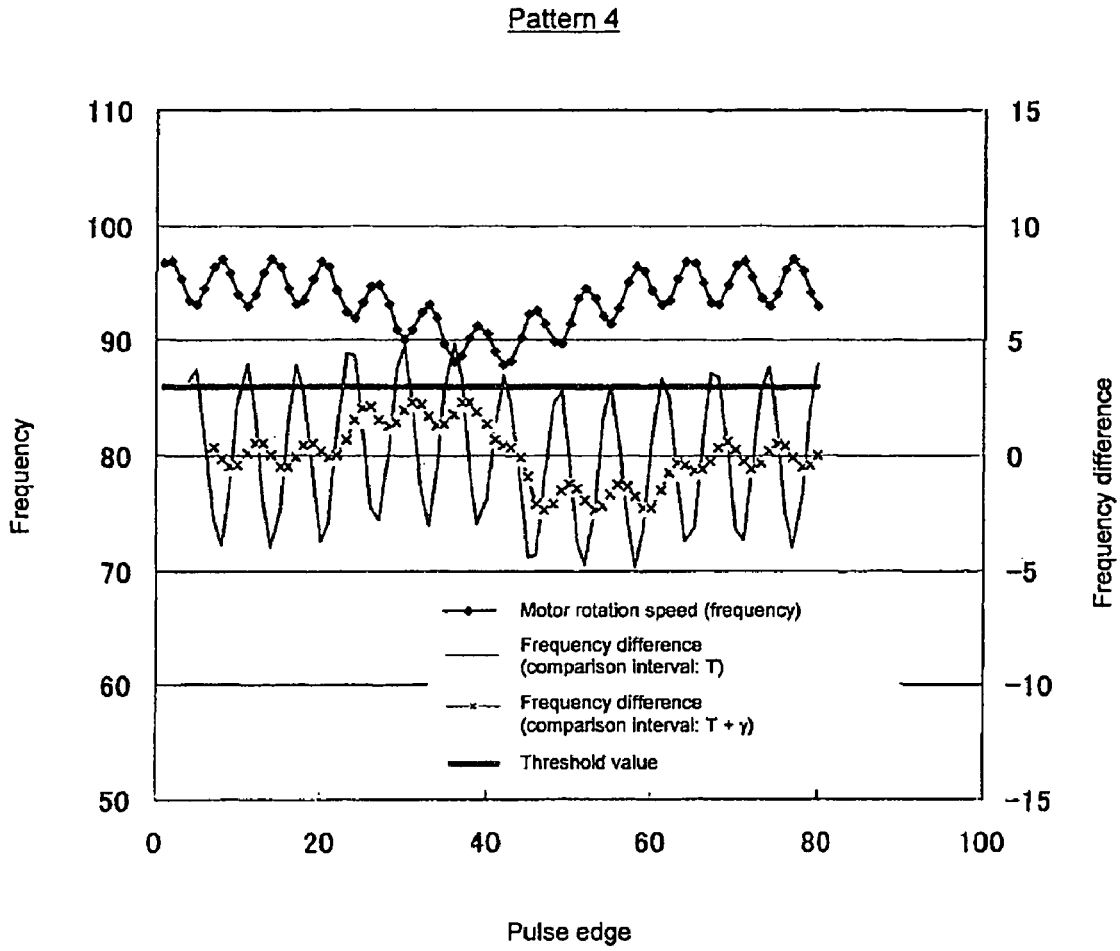
FIG. 26 shows a graph of a characteristic (pattern 4) of a motor rotation speed.

If longer than or equal to a constant period has passed from when the vehicle is bought, the rotation speed of the motor is not constant although entrapment has not occurred, and changes to the previously described pattern 2 (FIG. 24) or pattern 3 (FIG. 25) due to factors of deterioration of parts, increase in friction, and the like. The rotation speed is experimentally found to show a complex fluctuation as in pattern 4 of FIG. 26 if multiple factors exist. In any pattern, the frequency difference becomes larger and exceeds the threshold value when the comparison interval is T, and mistaken judgment that entrapment has occurred is made although entrapment has not occurred.

In the present embodiment, an aged change is detected based on a counter value of the operation counter 11, where the control unit 1 changes the comparison interval from T to T+γ or changes the comparison interval from T to T−α according to the pattern of the motor rotation speed when the counter value reaches a predetermined value K (e.g., K=10000), and calculates the frequency difference using the earlier past value or the past value closer to the present. The frequency difference becomes small and does not exceed the threshold value even if the fluctuation of the motor rotation speed is large, and thus judgment that entrapment has occurred is not made thereby preventing mistaken judgment.

Figure 21:
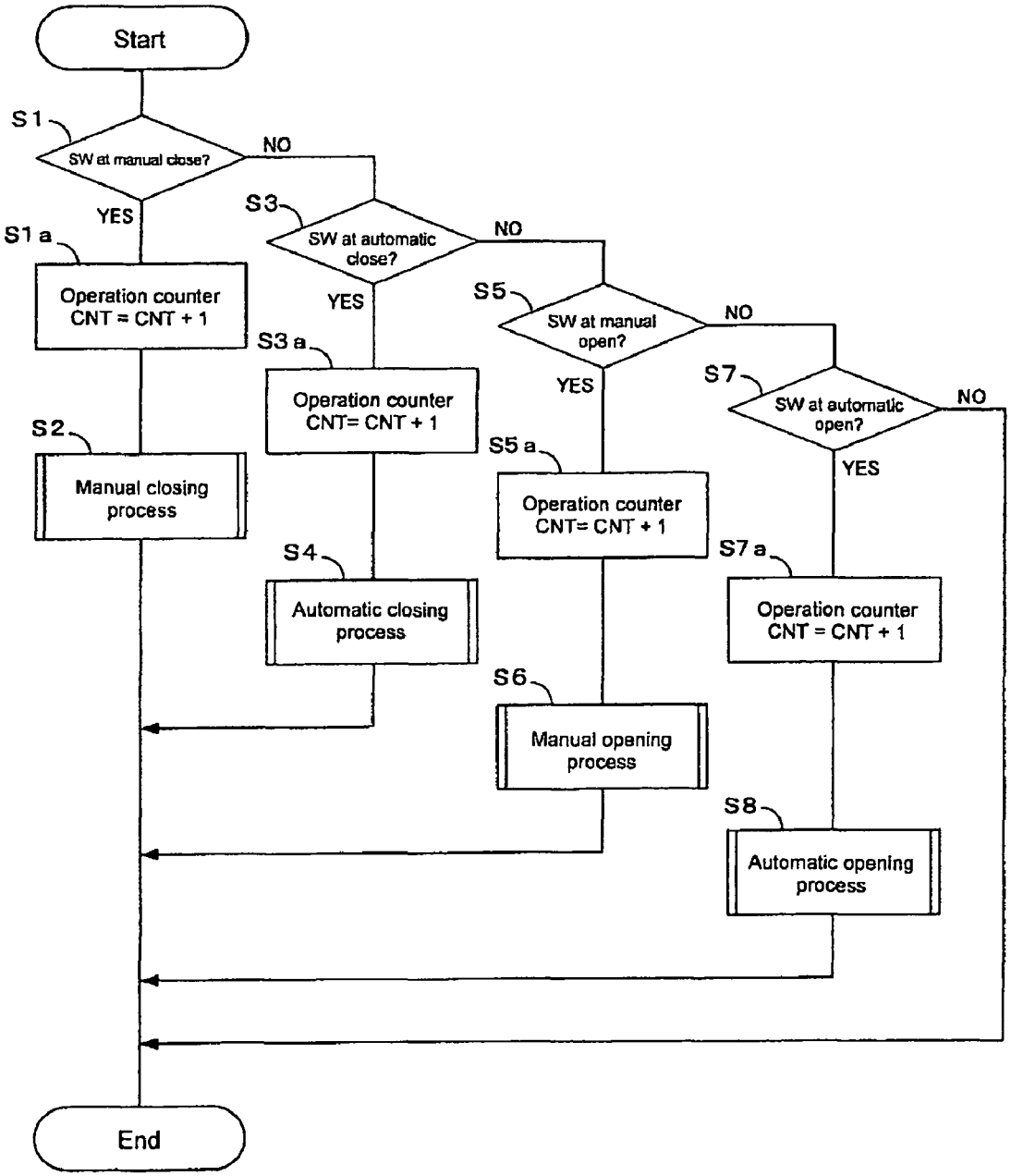
FIG. 21 shows a flowchart of an overall operation according to the fifth embodiment.
Figure 22:
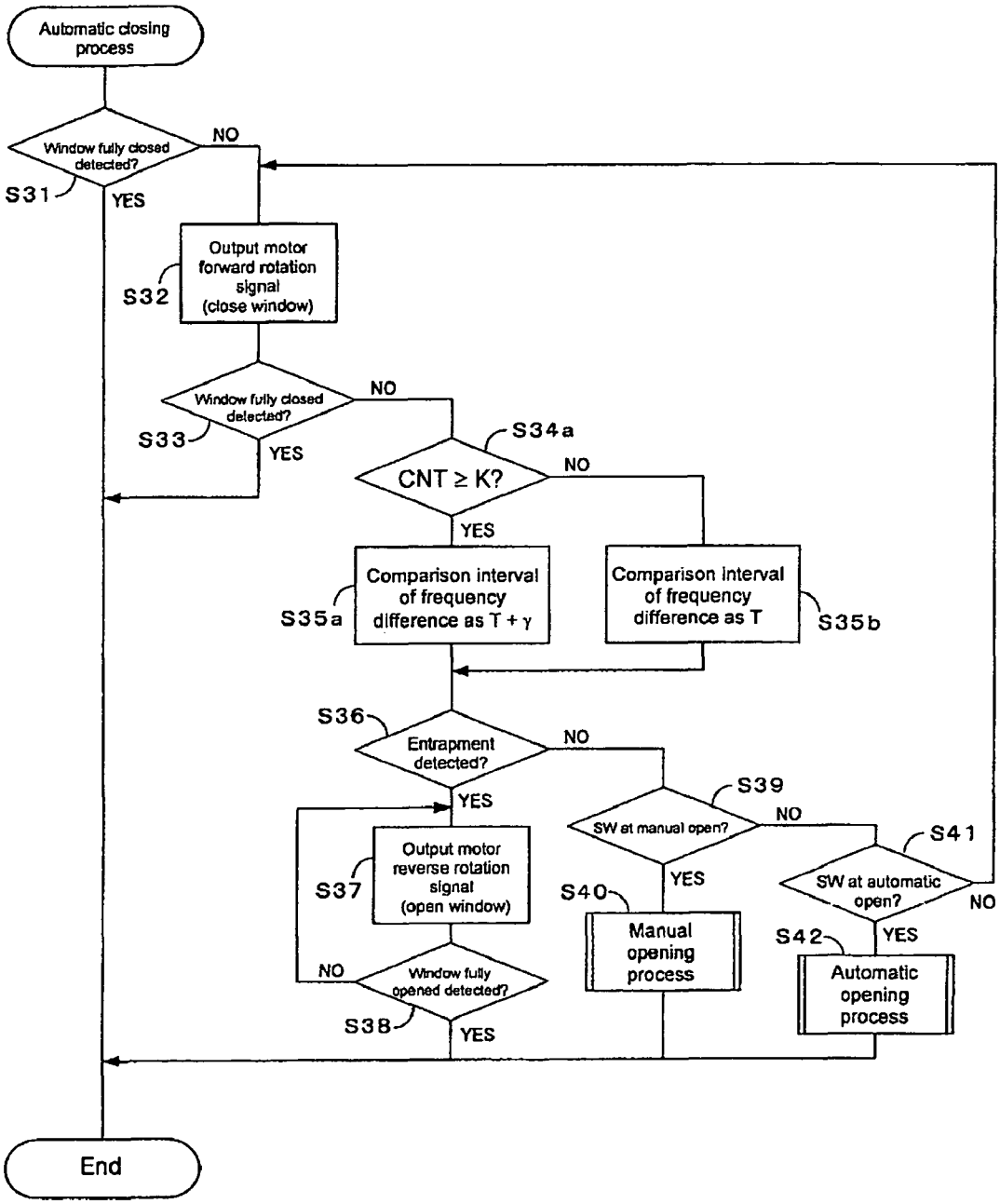
FIG. 22 shows a flowchart of the automatic closing operation in the fifth embodiment.

FIG. 21 and FIG. 22 show flowcharts of the operation according to the fifth embodiment. FIG. 21 shows a flowchart of the basic operation and corresponds to FIG. 7. In FIG. 21, same reference symbols are denoted for steps performing the same process as in FIG. 7. In FIG. 21, steps S1*a*, S3*a*, S5*a*, and S7*a* of adding 1 to the counter value CNT of the operation counter 11 respectively follow the steps S1, S3, S5, and S7. Thus, 1 is added to the counter value CNT of the operation counter 11 regardless of to which position the operation switch 7 is operated, that is, manual close, automatic close, manual open, or automatic open. In other words, the counter value CNT is incremented by +1 every time the opening and closing operation of the window is performed.

FIG. 22 shows a flowchart of the operation in the automatic closing process and corresponds to FIG. 9. In FIG. 22, same reference symbols are denoted for steps performing the same process as in FIG. 9. FIG. 22 differs from FIG. 9 in the portion of steps S34*a*, S35*a*, and S35*b*. Furthermore, step S43 of FIG. 9 is omitted in FIG. 22. In step S34*a*, whether or not the counter value CNT of the operation counter 11 has reached a predetermined value K is made, where if the counter value CNT has not reached the predetermined value L (step S34*a*: NO), the comparison interval of the frequency difference is set as T (step S35*b*), and entrapment detection is performed using the frequency difference calculated based on such comparison interval (step S36). The method of detecting entrapment is the same as in the first embodiment. If the counter value CNT of the operation counter 11 reaches the predetermined value K (step S34*a*: YES), the comparison interval of the frequency difference is changed from T to T+γ (step S35*a*), and entrapment detection is performed using the frequency calculated based on such comparison interval (step S36).

In FIG. 22, the comparison interval of the frequency difference is changed from T to T+γ in step S35*a*, but the comparison interval may be changed from T to T−α. The values of T, α, and γ are suitably selected according to the motor characteristics. In FIG. 20, the operation counter 11 added through the operation of the operation switch 7 is arranged, but an operation counter in which the initial value is set to K and subtracted through the operation of the operation switch 7 may be arranged, where the comparison interval of the frequency difference is changed when the counter value becomes 0. Furthermore, a traveling distance counter for counting the traveling distance of the vehicle may be arranged instead of the operation counter as the aged change detecting unit, where the comparison interval of the frequency difference is changed when the traveling distance reaches a constant value.

The rotation speed of the motor 3 is detected based on the frequency of the pulse in each embodiment described above, but in place thereof, the rotation speed may be detected based on the cycle of the pulse. Alternatively, the rotation speed may be detected based on the value of the current flowing to the motor 3. In this case, a current detecting circuit is arranged as the speed detecting unit.

An example of a window glass of the vehicle has been described as the opening/closing member in each embodiment described above, but the present invention is also applicable to the control of the opening/closing member such as back door and sunroof of the vehicle. Furthermore, the present invention is not limited to vehicles and is also applicable to opening/closing control of windows, doors, and the like of a building.

What is claimed is:

1. A control device for opening/closing member comprising:

a speed detecting unit for detecting a rotation speed of a motor for opening/closing the opening/closing member;

a variation calculating unit for calculating variation in the rotation speed based on a present value and a past value of the rotation speed detected by the speed detecting unit;

a judgment unit for comparing the variation calculated by the variation calculating unit and a predetermined threshold value and judging whether or not a foreign object is entrapped in the opening/closing member based on the comparison result;

a control unit for controlling the motor to open or stop the opening/closing member when judged that the foreign object is entrapped by the judgment unit; and a state detecting unit for detecting a state of the opening/closing member or state of surrounding of the opening/closing member; wherein the variation calculating unit selects an earlier past value or a past value close to the present as the past value of the rotation speed according to the state detected by the state detecting unit, and calculates the variation in the rotation speed using the selected past value and the present value.

2. A control device for opening/closing member according to claim 1, wherein the state detecting unit is a position detecting unit for detecting a position of the opening/closing member; and the variation calculating unit selects an earlier past value as the past value of the rotation speed when the position detecting unit detects that the opening/closing body has moved a predetermined distance in a direction that a movement speed decreases, and calculates the variation in the rotation speed using the past value and the present value.

3. A control device for opening/closing member according to claim 2, wherein the variation calculating unit calculates the variation in the rotation speed based on the present value of the rotation speed and a past value at a time point of a first period T1 before the present value until the position detecting unit detects that the opening/closing member has moved the predetermined distance in the direction that the movement speed decreases, and calculates the variation in the rotation speed based on the present value of the rotation speed and a past value at a time point of a second period T2 (T2>T1) before the present value after a time point at which the position detecting unit has detected that the opening/closing member has moved the predetermined distance in the direction that the movement speed decreases.

4. A control device for opening/closing member according to claim 2, wherein the opening/closing member is connected to a freely turning arm that moves in conjunction with the motor, and is movable in an up and down direction by turning of the arm;

the opening/closing member moves from a fully opened position to a fully closed position as the arm turns upward from a horizontal state; and the variation calculating unit calculates the variation in the rotation speed using the past value at the time point of the second period before when the arm turns by a constant amount from the horizontal state and the opening/closing member moves by the predetermined distance and approaches the fully closed position.

5. A control device for opening/closing member according to claim 1, wherein the state detecting unit is a weight detecting unit for detecting a weight of a passenger; and the variation calculating unit selects an earlier past value as the past value of the rotation speed when the weight of the passenger detected by the weight detecting unit is smaller than a predetermined value, and calculates the variation in the rotation speed using the past value and the present value.

6. A control device for opening/closing member according to claim 1, wherein the state detecting unit is a temperature detecting unit for detecting a surrounding temperature of a vehicle body; and the variation calculating unit selects an earlier past value or a past value closer to the present as the past value of the rotation speed when the surrounding temperature detected by the temperature detecting unit is a high temperature of higher than or equal to a predetermined value, and calculates the variation in the rotation speed using the past value and the present value.

7. A control device for opening/closing member according to claim 1, wherein the state detecting unit is a temperature detecting unit for detecting a surrounding temperature of a vehicle body; and the variation calculating unit selects an earlier past value or a past value closer to the present as the past value of the rotation speed when the surrounding temperature detected by the temperature detecting unit is lower than a predetermined value, and calculates the variation in the rotation speed using the past value and the present value.

8. A control device for opening/closing member according to claim 1, wherein the state detecting unit is a traveling road surface condition detecting unit for detecting a state of the traveling road surface; and the variation calculating unit selects an earlier past value or a past value closer to the present as the past value of the rotation speed according to the state of the traveling road surface detected by the traveling road surface condition detecting unit, and calculates the variation in the rotation speed using the past value and the present value.

9. A control device for opening/closing member according to claim 1, wherein the state detecting unit is an aged change detecting unit for detecting aged change; and the variation calculating unit selects an earlier past value or a past value closer to the present as the past value of the rotation speed according to the aged change detected by the aged change detecting unit, and calculates the variation in the rotation speed using the past value and the present value.

* * * * *